US011375783B2

(12) United States Patent
Fazackerley et al.

(10) Patent No.: US 11,375,783 B2
(45) Date of Patent: Jul. 5, 2022

(54) THREE WAY CONVERTIBLE CONTAINMENT DEVICE

(71) Applicants: Amy S. Fazackerley, Alexandria, VA (US); Adam D. Fazackerley, Alexandria, VA (US)

(72) Inventors: Amy S. Fazackerley, Alexandria, VA (US); Adam D. Fazackerley, Alexandria, VA (US)

( * ) Notice: Subject to any disclaimer, the term of this patent is extended or adjusted under 35 U.S.C. 154(b) by 0 days.

(21) Appl. No.: 17/226,618

(22) Filed: Apr. 9, 2021

(65) Prior Publication Data

US 2021/0315336 A1 Oct. 14, 2021

Related U.S. Application Data

(60) Provisional application No. 63/007,550, filed on Apr. 9, 2020.

(51) Int. Cl.

| | |
|---|---|
| ***A45C 9/00*** | (2006.01) |
| ***A45C 7/00*** | (2006.01) |
| ***A45C 3/00*** | (2006.01) |
| ***A45C 13/10*** | (2006.01) |

(52) U.S. Cl.

CPC ..... *A45C 7/0059* (2013.01); *A45C 3/001* (2013.01); *A45C 9/00* (2013.01); *A45C 13/103* (2013.01); *A45C 13/1046* (2013.01); *A45C 2007/0013* (2013.01)

(58) Field of Classification Search

CPC ..... A45C 7/0059; A45C 3/001; A45C 7/0068; A45C 2007/0004; A45C 2007/0013; A45C 2009/004; A45C 13/103; A45C 2009/007; A45C 9/00; A34C 13/1046

USPC ..... 383/4; 190/125, 126

See application file for complete search history.

(56) References Cited

U.S. PATENT DOCUMENTS

| | | | | |
|---|---|---|---|---|
| 2,682,290 A * | 6/1954 | Ditlea | A45C 3/045 383/121 |
| 4,117,874 A * | 10/1978 | Berenguer | A45C 7/0077 383/28 |
| 5,158,220 A * | 10/1992 | Glass | A45C 1/02 224/235 |
| 5,819,343 A | 10/1998 | Zampirri, Jr. et al. | |
| 9,084,459 B2 | 7/2015 | Fazackerley et al. | |

(Continued)

OTHER PUBLICATIONS

Ex. Fidalgo Marron, B; International Search Report and Written Opinion issued in International Application No. PCT/US2021/026583 dated Jul. 23, 2021, 13 pages.

*Primary Examiner* — Sue A Weaver

(74) *Attorney, Agent, or Firm* — MH2 Technology Law Group, LLP

(57) ABSTRACT

A containment device that converts between three different forms and includes a multilayer base. The forms include: 1) a mat or work surface that has a raised lip or edge structure that contains items on the mat or work surface; 2) a small volume bag or flexible container for holding the items inside, where the lip is gathered or compacted, e.g., by a drawstring, to form an annulus from the lip; and 3) a larger-volume, cylindrical-shaped bag, which may be used as a shopping bag. The cylindrical-shaped bag may be stored between the layers of the base when the device is in the mat configuration or the drawstring bag configuration, and the lip may be stored between the layers of the base when the device is in the cylindrical-shaped bag configuration.

20 Claims, 16 Drawing Sheets

(56) References Cited

U.S. PATENT DOCUMENTS

| | | | | |
|---|---|---|---|---|
| 9,119,448 | B1 * | 9/2015 | Hirshberg | A45C 13/001 |
| 10,016,036 | B2 | 7/2018 | Fazackerley et al. | |
| 10,561,213 | B2 | 2/2020 | Fazackerley et al. | |
| 2006/0102673 | A1 * | 5/2006 | Collier | A45C 7/0068<br>224/581 |
| 2008/0050050 | A1 * | 2/2008 | Seecof | A45F 4/02<br>383/4 |
| 2010/0127024 | A1 * | 5/2010 | Cortes | A45F 4/02<br>224/153 |
| 2013/0279828 | A1 | 10/2013 | Huang | |
| 2014/0185963 | A1 | 7/2014 | Lown et al. | |
| 2017/0265612 | A1 * | 9/2017 | Wu | A45C 3/00 |
| 2020/0196722 | A1 | 6/2020 | Fazackerley et al. | |

* cited by examiner

THREE WAY CONVERTIBLE CONTAINMENT DEVICE

CROSS-REFERENCE TO RELATED APPLICATIONS

This application claims the benefit of U.S. Provisional Application No. 63/007,550, filed 9 Apr. 2020, which is hereby incorporated by reference in its entirety.

FIELD OF THE INVENTION

The present invention relates to convertible luggage, and more particularly, to a device that can be converted to: a mat that contains items; a drawstring container/bag; and a cylinder-shaped container/bag, which may include handles.

BACKGROUND

Projects and activities involving multiple items, such as play/toy pieces, small parts, components, collections, balls, supplies, cosmetics, groceries, military items, and the like, are difficult and time-consuming to clean up after. It is difficult to pick up large numbers of small items from a work or play surface and place them in a storage container. It also takes a long time, especially when the items have been scattered over a sizable area during use.

In the case of play/toy pieces, manufacturers or parents typically provide rigid or soft/flexible containers for storage of items when not in use on a play or work surface. Examples of typical rigid containers include large plastic containers, lunch boxes, picnic baskets, bins, baskets, and/or drawers. Examples of typical soft/flexible containers include backpacks, sacks, Zip-Lock™ brand storage bags, and pillow cases.

Such conventional containers have several drawbacks. For example, rigid containers are difficult to carry and stow because their rigidness does not allow them to conform to a person that is carrying them or to an available storage space. In addition, when more than a few small play/toy pieces are placed in a rigid container, the pieces stack up on one another, and the users, such as children, are neither able to see nor get to the pieces that shift to the center or bottom of these containers. This makes it difficult to play with, or even see, all of the pieces of, for example, a play set.

Another drawback of rigid containers is that they are inconvenient to transport to another location, especially when they contain a heavy quantity of items. For example, a rigid container cannot be comfortably slung on one's back and walked with, for example, to a neighbor's house or down the aisle of an airliner. In addition, rigid containers are typically breakable, and a broken container may release small items held inside. For example, if a rigid plastic container containing small building block toys is dropped on a hard floor in an airport, or on a driveway at a neighbor's house, it may crack open, scattering the building block toys that were held inside.

Typical flexible containers, such as tote bags and sacks, do not securely contain small items, such as play pieces or work items that are only a few millimeters in size, because they are designed to stop the passage of large items, such as books and clothing, and because they do not securely and completely close their openings. Lacking means for completely and securely closing all openings, tote bags and sacks do not prevent small pieces from falling out when dropped, flipped, or shaken, as might occur during transport by person or car, or as airline baggage. And, like rigid containers, the sack-like or bag-like shape of a flexible container causes pieces to stack up on one another, such that a user of the pieces is neither able to see nor get to the pieces that shift to the middle or bottom of the container.

The most common user's solution, and especially a child's solution, to this problem is to dump the pieces out of the container so that they are all visible. This solution, however, creates another drawback when it is time to stop participating in the activity. To clean up, the small play/toy pieces must be picked-up individually, lifted, and put back into the container. If a child or elderly/disabled parent/caregiver is performing this task on small items, the clean-up process may be very difficult. And even for the able-bodied, this clean-up process is slow, tedious, prone to losing pieces, and often frustrating.

For items that are dumped or unpacked from a container to play or work with, parents may provide a separate play or work surface, such as a flat mat, sheet, or blanket. For example, a child may dump play pieces from a backpack onto a flat play mat, which provides cushioning for the pieces and the child, and protects the underlying surface (e.g., a floor or table) from wear. A flat play mat, however, does not restrict the movement or aid clean up of pieces at the end of play, as children typically push and scatter play pieces off of the surface of a play mat while dumping from a container onto a mat, and during play. Thus, even when a flat play mat is used, all pieces that scatter off the mat must typically be picked-up individually, lifted, and put back into a container.

A drawstring bag (e.g., a bag that is closed using a cinch cord) is useful, but it suffers from having a small internal volume, which is due to the bag being shaped similar to a sphere when the bag is closed and compressed by the cinch cord or drawstring. Consequently, drawstring bag often cannot contain many types of large or bulky items that a user may wish to put inside, such as boxed foods (e.g., breakfast cereal and the like), bagged foods (e.g., potato chips and the like), paper goods (e.g., paper towel rolls and the like), or other types of groceries or consumer items.

Accordingly, there is a need for a device that addresses the above-notes problems and drawbacks with existing bags and mats.

SUMMARY

Embodiments consistent with the invention includes devices and apparatuses for containing items that convert between at least three different forms or configurations, each of which functions to contain items. In various embodiments, the configurations included a containment mat configuration, a drawstring bag configuration, and a cylindrical shaped bag configuration, all of which are formed by a single device.

In various embodiments, the device includes a flexible, approximately elliptical base that has a perimeter and that comprises a first layer of material and a second layer of material, wherein the first layer of material includes an opening; a flexible lip having a length that is approximately equal to a circumference of the flexible, approximately elliptical base, the flexible lip comprising at least one piece of thin material that is configured to form at least one envelope; wherein the flexible lip is attached near the perimeter of the flexible, approximately elliptical base such that, in a first configuration, at least a portion of the flexible lip is disposed substantially perpendicular to the flexible, approximately elliptical base when the flexible, approximately elliptical base is deployed flat in a substantially horizontal position; at least one cord running through the at least one envelope of the flexible lip, wherein pulling the at least one cord forms the device into a first bag that has an annular passage that is nearly completely closed by the at least one piece of thin material of the flexible lip; and a flexible wall that is attached to the flexible, approximately elliptical base such that the flexible, approximately elliptical base and the wall form an approximately cylindrical bag when the device is in a second configuration. In such embodiments, the flexible wall of the approximately cylindrical bag is disposed between the first layer of material and the second layer of material of the base when the device is in the first configuration, and the flexible lip is disposed between the first layer of material and the second layer of material of the base when the device is in the second configuration.

With such a device, a user obtains the ability to retain a number of items in a first configuration that allows the items to be rapidly contained and transported, and also the ability to substantially increase containment volume, by implemented the second configuration, when needed and without changing or adding devices.

In some embodiments, the flexible, approximately elliptical base is a flexible circular base.

In some embodiments, the device further includes at least one cord clamping device, adjustable attached to the at least one cord. In some of those embodiments, the at least one cord clamping device is a cord lock. By providing such a cord clamping device, it becomes possible to ensure that the device remains in the closed configuration, even when the device is placed in an inverted position to allow for accessing the cylindrical shaped bag of the second configuration.

In various embodiments, the at least one piece of thin material that is configured to form at least one envelope comprises two pieces of thin material that are configured to form two envelopes; and the at least one cord running through the at least one envelope of the flexible lip comprises two cords running through the two envelopes. In some such embodiments, the device further includes two cord locks, adjustable attached to the two cords.

In various embodiments, the at least one piece of thin material comprises at least one piece of thin nylon material or thin polyester material.

In various embodiments, pulling the at least one cord forms the device into a bag that has an annular passage that is completely closed by the at least one piece of thin material of the flexible lip.

In various embodiments, the flexible lip and the wall of the approximately cylindrical bag are attached to the perimeter of the approximately elliptical base by stitches. By stitching the flexible lip and the wall to the base using stitches, an aesthetic design may be obtained while also providing durability exceeding that of other fastening methods, for example, adhesive.

In some embodiments, the device further includes a fastener connected to the opening, wherein the fastener seals and unseals the opening. And in some such embodiments, the fastener is a zipper. By using a zipper, opening and closing of the base is facilitated while also ensuring that objects within the first configuration do not interfere with the material forming the cylindrical bag.

Another embodiment is a device for containing items that includes: a flexible, polygonal base that has a perimeter and that comprises a first layer of material and a second layer of material, wherein the first layer of material includes an opening; a flexible lip having a length that is approximately equal to a circumference of the flexible, polygonal base, the flexible lip comprising at least one piece of thin material that is configured to form at least one envelope; wherein the flexible lip is attached near the perimeter of the flexible, polygonal base such that, in a first configuration, at least a portion of the flexible lip is disposed substantially perpendicular to the flexible polygonal base when the flexible polygonal base is deployed flat in a substantially horizontal position; at least one cord running through the at least one envelope of the flexible lip, wherein pulling the at least one cord forms the device into a first bag that has an annular passage that is nearly completely closed by the at least one piece of thin material of the flexible lip; and a flexible wall that is attached to the flexible, polygonal base such that the flexible, polygonal base and the wall form an approximately cylindrical bag when the device is in a second configuration. In this embodiment, the flexible wall of the approximately cylindrical bag is disposed between the first layer of material and the second layer of material of the base when the device is in the first configuration, and the flexible lip is disposed between the first layer of material and the second layer of material of the base when the device is in the second configuration.

This device, and its variants, have the same or similar technical advantages as those described above.

In various embodiments, the device further includes at least one cord clamping device, adjustable attached to the at least one cord. In some such embodiments, the at least one cord clamping device is a cord lock.

In various embodiments, the at least one piece of thin material that is configured to form at least one envelope comprises two pieces of thin material that are configured to form two envelopes; and the at least one cord running through the at least one envelope of the flexible lip comprises two cords running through the two envelopes. In some such embodiments, the device further includes two cord locks, adjustable attached to the two cords.

In various embodiments, the at least one piece of thin material comprises at least one piece of thin nylon material or thin polyester material.

In various embodiments, pulling the at least one cord forms the device into a bag that has an annular passage that is completely closed by the at least one piece of thin material of the flexible lip.

In various embodiments, the flexible lip and the wall of the approximately cylindrical bag are attached to the perimeter of the polygonal base by stitches.

In yet other embodiments, the device further includes a fastener connected to the opening, wherein the fastener seals and unseals the opening.

It is intended that combinations of the above-described elements and those within the specification may be made, except where otherwise contradictory.

BRIEF DESCRIPTION OF THE DRAWINGS

The accompanying drawings, which are incorporated in and constitute a part of this specification, illustrate embodiments of the invention and together with the description, serve to explain the principles of the invention.

DESCRIPTION OF THE EMBODIMENTS

Figure 1:
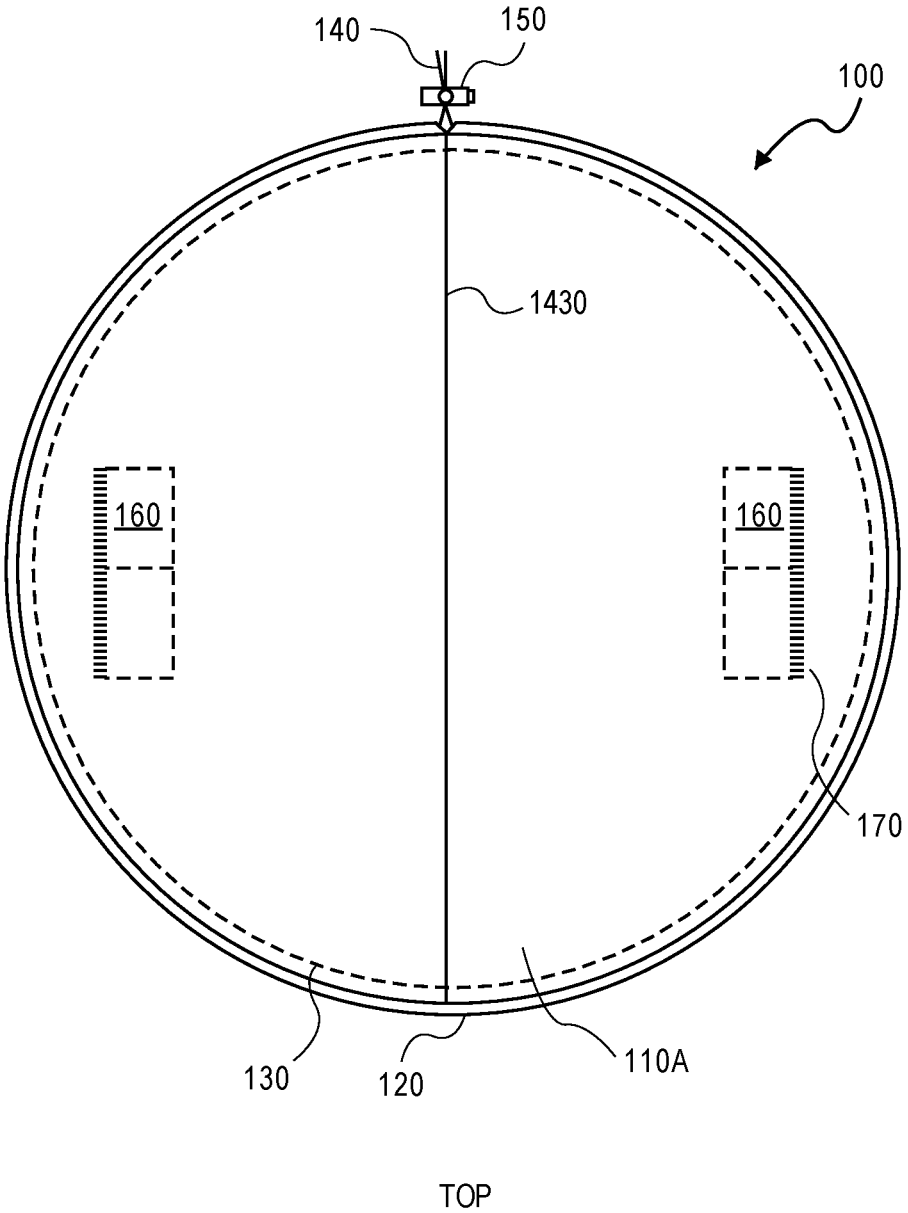
FIG. 1 is a top view of an example of a three-way convertible containment device in a mat configuration, consistent with embodiments of the invention.

Generally, embodiments consistent with the present invention include, among other things, luggage or carrying container devices or the like that convert to form: 1) a mat or work surface that has a raised lip or edge structure that contains items on the mat or work surface; 2) an approximately spherical bag or flexible container, which may, for example, be sealed using the lip or edge structure in conjunction with a drawstring, cinch cord, or the like; and 3) a relatively larger, approximately cylindrical bag, which may include carrying handles and an open end, similar to a shopping bag.

Conventional non-convertible bags, luggage, flexible containers, containment devices, etc. are limited to one configuration—such as a sack, a drawstring bag, a shopping bag, or the like. They cannot be configured or used as different type of bag or as a containment mat or a work mat that prevents items from leaving the mat's surface. Some devices convert between two configurations: a bag configuration and a containment mat configuration. Such devices employ the flexible base of the device as the wall of the bag in the bag configuration, and typically include a drawstring or cinch cord to form and close the bag. This first drawstring bag configuration forms an approximately spherical or teardrop shape, where the surface area of the bag is a slightly less or approximately equal to the area of the base of the device in the mat configuration.

Various embodiments consistent with the present disclosure provide a second, approximately cylindrical bag configuration, whose surface area and internal volume are not limited by the size of the base. The cylindrical-shaped bag provides a larger internal volume for carrying items than the volume provided by the drawstring bag configuration, and does so without changing or adversely affecting the functionality of the containment mat configuration or the drawstring bag configuration. In addition, embodiments consistent with the present disclosure advantageously provide three different configurations in a single device that weighs only slightly more than, and that can be folded when empty into only slightly more space than, a two-configuration device.

, Various embodiments consistent with the present disclosure provide three configurations in a single convertible containment device, and provide a user with three different capabilities in one device. For example, when used in traveling, a traveler can employ the device disclosed herein in multiple situations and for multiple different requirements and uses, while enjoying the convenience, efficiency, and weight savings of only having to remember to bring, pack, carry, and use a single containment device. For instance, embodiments consistent with the present disclosure can be used: 1) in the small, drawstring bag configuration to hold makeup or other small items while on a plane, in a car, etc.; 2) in the containment mat configuration to confine small item (e.g., makeup) on a large flat surface, such as a bathroom counter; and 3) in the larger, cylindrical-shaped bag configuration to carry large items at a travel or shopping destination (e.g., to carry groceries from a store to a rented vacation house).

Reference will now be made in detail to various embodiments of the invention, examples of which are illustrated in the accompanying drawings. Wherever convenient, the same reference numbers will be used throughout the drawings to refer to the same or like parts.

FIG. 1 is a top view of an exemplary three-way convertible containment device 100 in a mat configuration, consistent with embodiments of the invention. In the example shown in FIG. 1, three-way convertible containment device 100 is spread out in a mat or work surface configuration with a top side 110A of a base 110 facing upward. In various embodiments, base 110 may be elliptical, circular (as shown), or oval in shape. In some embodiments, base 110 may be in the shape of a polygon, such as an equilateral, cyclic polygon having six or more sides, e.g., a hexagon, an octagon, etc. Other embodiments of base 110 may be in the shape of a many-sided polygon. For example, it may approximate an elliptical or oval shape, e.g., a dodecagon, an elongated dodecagon shape, etc. In various embodiments, the diameter or longest dimension of base 110 may be in the range of about 4 inches to about 120 inches or larger, including embodiments of 18 inches and 60 inches.

In some embodiments, base 110 may be formed of two or more pieces or layers of flexible material, such as denim, suede, leather, velvet, canvas, cotton twill, large denier polyester, large denier nylon, ballistic nylon, ripstop nylon, nylon mesh fabric, sail oxford ripstop nylon, Cordura™ brand fabric, packcloth, or the like. In some embodiments, at least one layer of the base 110 may be formed of a lightweight flexible material, such as 1.9 oz calendared rip-stop nylon material, microfiber fabric, taffeta fabric, or the like. In some embodiments, top surface or layer 110A of base 110 may be formed of a lightweight flexible material, such as 1.9 oz calendared rip-stop nylon material, to provide a work or play surface having specific desired qualities, such as being waterproof, stain resistant, pleasant to touch, colorful, easily able to custom print, etc. In such embodiments, bottom surface or layer 110B (not shown in FIG. 1) of base 110 may be formed of a relatively heavyweight flexible material, such as 10 oz cotton denim fabric or ballistic nylon, for example 1000 denier ballistic nylon. In some embodiments, regardless of the number of layers, base 110 may be formed of multiple materials in sections, such as a ballistic nylon, outer-periphery donut-shaped section, surrounding a nylon mesh "bull's-eye" inner section.

As shown in the embodiment of FIG. 1, at least the top surface or layer 110A of the base 110 includes an opening 1430, which may be in the form of a placket, vent, slit, or the like, and which allows access to the space(s) between the layers of the base 110. In some embodiments, other layers in addition to the top surface or layer 110A may also have openings similar to opening 1430. In some embodiments, the opening 1430 may be implemented as a placket, which may, in some embodiments, include one or more fasteners, such as hook and loop fasteners or buttons. In various embodiments, there may be more than one opening 1430 in a layer 110A, 110B of the base 110, and these opening(s) may be used to turn the base 110 inside out and convert the device 100 from one configuration to another, as described herein.

As shown in FIG. 1, a lip 120 is attached to the perimeter of base 110 in a manner that causes at least a portion of lip 120 to stand substantially perpendicular to base 110 when base 110 is spread out on a substantially horizontal surface. Lip 120 forms a wall or barrier around the top surface 110A, and acts to contain any items, parts, or pieces placed on top surface or layer 110A while a user utilizes the items, parts, or pieces. See, for example FIGS. 3 and 4.

In various embodiments, lip 120 stands up substantially perpendicular to base 110 due at least in part to the configuration of lip 120, e.g., its dimensions, such as vertical height above horizontal base 110, and its length in relation to the circumference or peripheral distance around base 110, and its folded form in certain embodiments. In some embodiments, lip 120 stands up substantially perpendicular to base 110 due at least in part to its fabrication from lightweight flexible material, such as 1.9 oz calendared rip-stop nylon material, including its fabrication from a material that is more flexible and lower in weight and density compared to a thicker, more rigid material (e.g., 10 oz. denim) that forms base 110. In some embodiments, lip 120 stands up substantially perpendicular to base 110 due at least in part to its method or implementation of attachment to base 110. In some embodiments, lip 120 stands up substantially perpendicular to base 110 due at least in part to the elliptical, oval, or polygonal shape of base 110. In some embodiments, lip 120 stands up substantially perpendicular to base 110 due at least in part to the presence of a particular length of string or cord inside an envelope formed by lip 120. In some embodiments, lip 120 stands up substantially perpendicular to base 110 due at least in part to a separate stiffening structure such as perpendicular support members attached to the base 110 and situated inside an envelope formed by lip 120.

Figure 5:
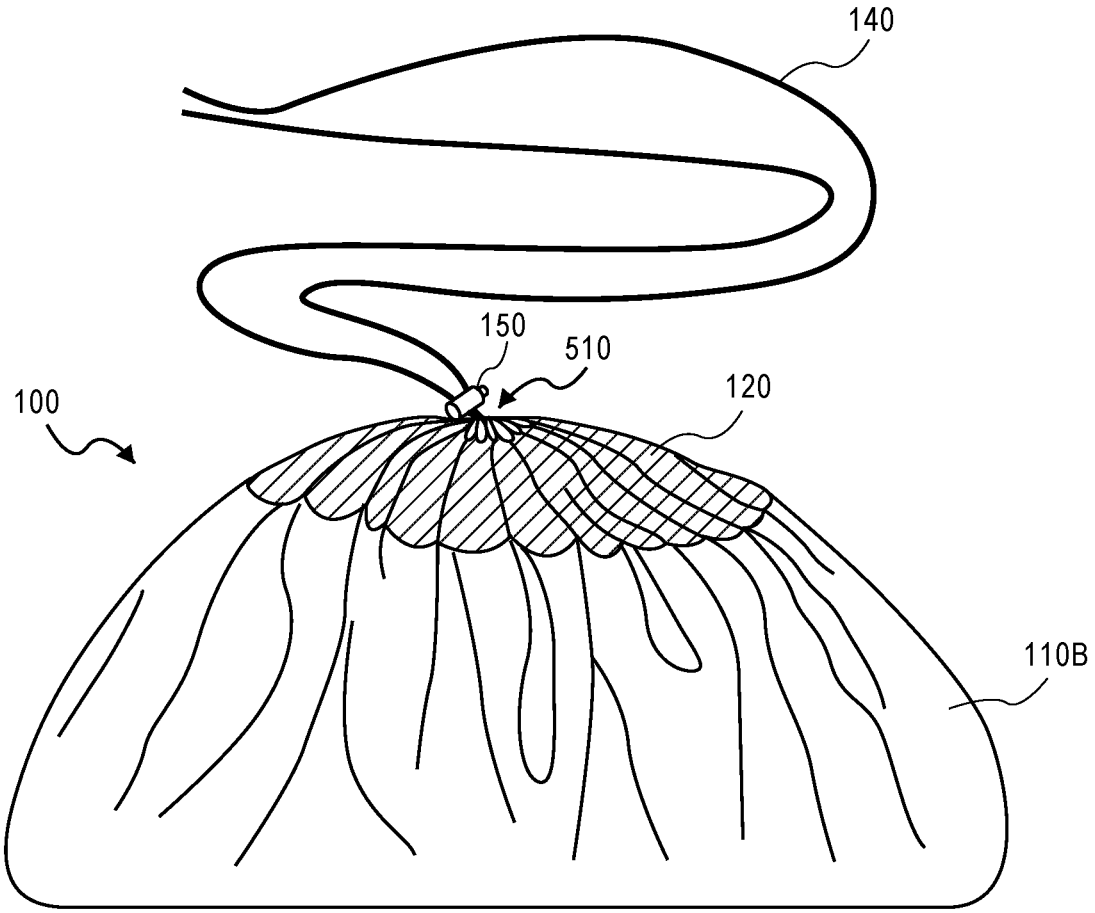
FIG. 5 is a side view of an example of a three-way convertible containment device in a drawstring bag configuration, consistent with embodiments of the invention.

As shown in the exemplary embodiment of FIG. 1, lip 120 may be attached to base 110 by stitches 130. In various embodiments, lip 120 may be configured (e.g., folded over) to form a channel or envelope through which a cinch cord 140 may pass. In various embodiments, cinch cord 140 (e.g., drawstring) may be pulled to change convertible containment device 100 from the open, flat, mat configuration shown into a closed bag-like configuration (as shown in FIG. 5). In the embodiment shown, cinch cord 140 comes out of adjacent openings of the envelope formed by lip 120 at a single point of the periphery of base 110. As shown in FIG. 1, cinch cord 140 may also pass through a cord lock 150, which may be adjustably employed to clamp and maintain convertible containment device 100 in a closed bag-like configuration. In some embodiments, cinch cord 140 may be constructed of 3 mm or 5 mm climbing cord.

In the embodiment shown in FIG. 1, top surface 110A of base 110 includes interior pockets 160, which may be formed of flexible material, such as various types of fabric, including for example see-through vinyl plastic, that is sewn or otherwise attached to base 110. Interior pockets 160 may be used to contain and separate chosen items from other items contained in convertible containment device 100, especially when convertible containment device 100 is in a bag-like luggage configuration. In the embodiment shown, interior pockets 160 may use zippers 170 to open and close the pocket opening. In other embodiments, buttons, Velcro® brand strips or other closure means may be used to prevent any contents of interior pockets 160 from leaving interior pockets 160. The dimensions, and even the presence, of interior pockets 160 are not critical. As an example, in an embodiment where the diameter of base 110 is about 60 inches, the dimensions of interior pockets 160 may be about 6 inches by about 14 inches.

Figure 2:
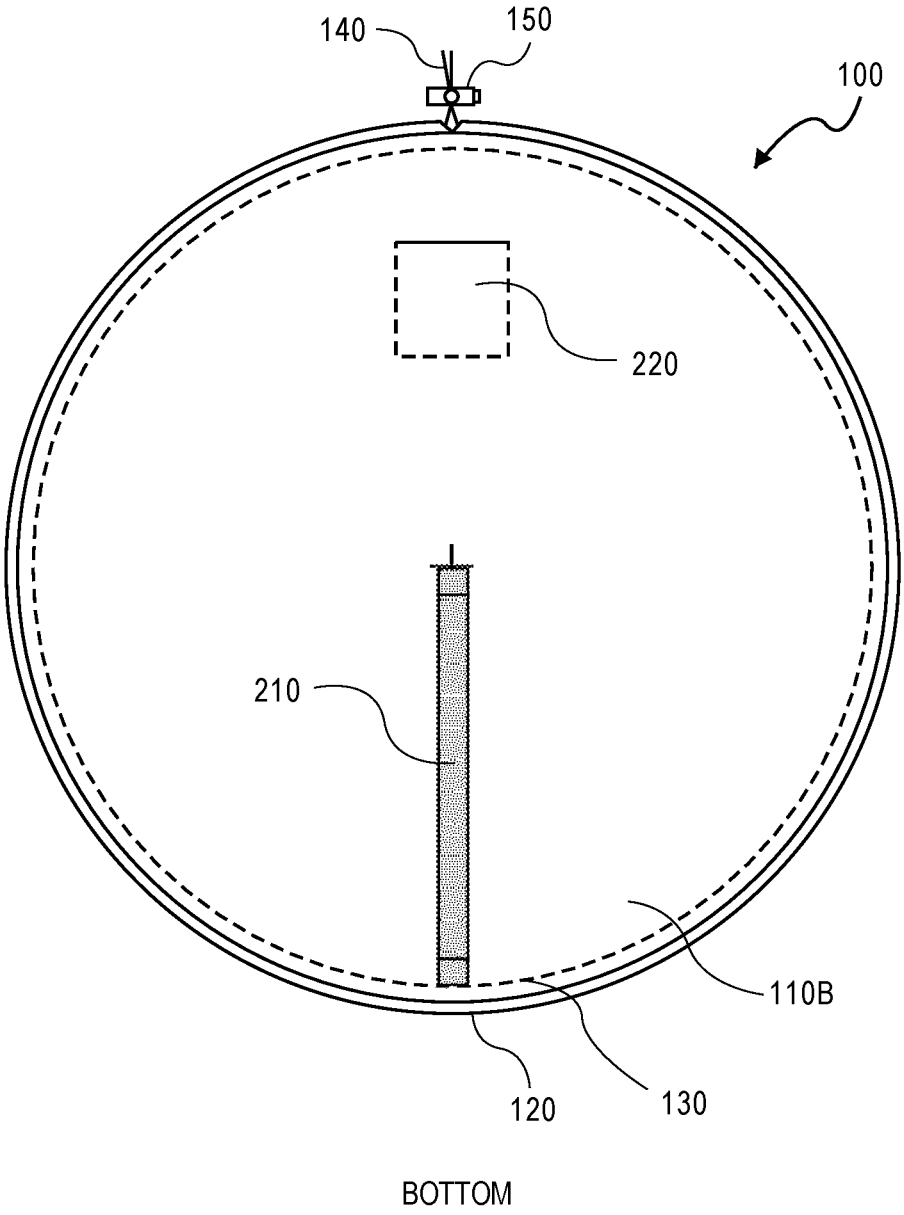
FIG. 2 is a bottom view of an example of a three-way convertible containment device in a mat configuration, consistent with embodiments of the invention.

FIG. 2 is a bottom view of an exemplary three-way convertible containment device 100 in a mat configuration, consistent with embodiments of the invention. As shown by the bottom view of FIG. 2, base 110 includes a bottom surface or layer 110B. As noted above, in some two-piece embodiments of base 110, bottom surface layer 110B of base 110 may be formed of a heavyweight flexible material, such as 10 oz cotton denim fabric or ballistic nylon, while top surface 110A (not shown in FIG. 2) of base 110 may be formed of a flexible material better suited as a work or play surface, including materials that possess waterproof and/or stain resistant properties, such as lightweight nylon materials. In some embodiments, the bottom layer 110B may include a slit or opening (not shown in FIG. 2), similar to the opening 1430 shown in FIG. 1. In various such embodiments, an opening in the layer 110B may be in addition to, or as an alternative to, the opening 1430 in the layer 110A shown in FIG. 1.

In the embodiment shown in FIG. 2, bottom surface 110B of base 110 includes a cord pocket 220, which may be formed of flexible material, such as various types of fabric, sewn or otherwise attached to base 110. In various embodiments, cord pocket 220 may include one or more Velcro® brand strips to secure items, in particular the cinch cord 140, inside cord pocket 220. In other embodiments, buttons, snaps, zippers, or other closure means may be used to secure cinch cord 140 inside cord pocket 220. The dimensions of cord pocket 220 are not critical, as long as cord pocket 220 can easily store cinch cord 140, which may have a length approximately equal to the circumference or periphery length of base 110.

In the exemplary embodiment shown, cinch cord 140 comes out two openings in the envelope or channel 710 formed by lip 120 (see FIG. 7) at a point of the periphery of base 110 that is near the opening of cord pocket 220. In another embodiment, cinch cord 140 may come out of openings in the envelope or channel 710 formed by lip 120 at two points of the periphery of base 110, such as two points on a diameter of base 110. Such an embodiment may include two cord pockets 220 positioned near the two points on the diameter of base 110 where cinch cord 140 emerges from the envelope of lip 120. In such an embodiment, lip 120 may be formed of two separate pieces, each having a length approximately one-half the circumference of base 110, or less (e.g., up to about 15% less), and cinch cord 140 may include two cord locks 150 and/or there may be two cinch cords 140. Embodiments in which cinch cord(s) 140 comes out of openings in the envelope or channel formed by lip 120 at more than two points of the periphery of base 110 are also possible.

As shown, a carrying strap 210 is also attached to bottom surface 110B. Carrying strap 210 may be formed of strong, flexible material, such as various types of fabric, which are sewn, riveted, or otherwise attached to base 110. Carrying strap 210 may be used to lift and carry convertible containment device 100, especially when convertible containment device 100 is in a bag-like luggage configuration. In various embodiments, carrying strap 210 may be constructed of nylon webbing material, and may include a padded section. The dimensions, the attachment points, the number, and even the presence, of carrying strap 210 are not critical. As an example, in an embodiment where the diameter of base 110 is about 60 inches, the length of carrying strap 210 may be about 28 or 29 inches. As another example, in an embodiment where the diameter of base 110 is about 15 inches, a relatively short (e.g., 8 inch or hand sized) carrying strap (see FIG. 4) may be used, having a first attachment point on bottom surface 110B of base 110 and the other attachment point opposite the first attachment point on top surface 110B of base 110. As yet another example, two separate carrying straps 210 (not shown) may be provided, configured such that one strap may go over each shoulder of a person, and convertible containment device 100 may be transported as a backpack or knapsack.

Figure 3:
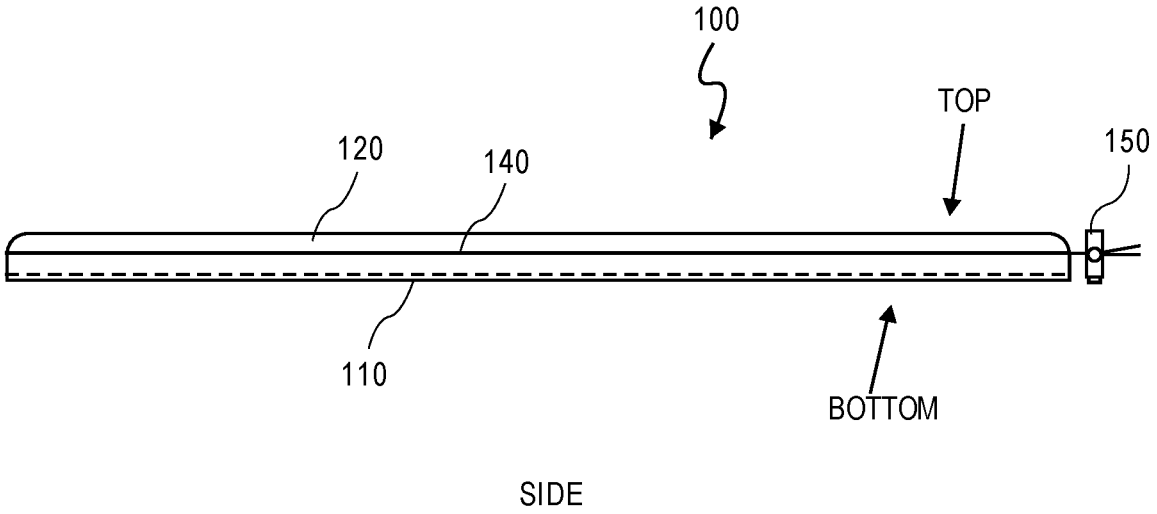
FIG. 3 is a side view of an example of a three-way convertible containment device in a mat configuration, consistent with embodiments of the invention.

FIG. 3 is a side view of an exemplary three-way convertible containment device 100 in a mat configuration, consistent with embodiments of the invention. In the view shown, base 110 is deployed on a horizontal surface, and lip 120 is standing substantially perpendicular to base 110 and is substantially vertical. In the implementation shown, lip 120 stands at a uniform height throughout its length. In various implementations (not shown), lip 120 may not stand to a uniform height, as portions of lip 120 may flex, sag, or flop over to some degree (e.g., as a function of the flexibility of the material used to form lip 120), reducing the deployed height in localized sections of lip 120.

In FIG. 3, cinch cord 140 is depicted as running inside a cavity or envelope formed by the flexible material of lip 120, up to a point where cinch cord 140 emerges from the cavity, close to where cord lock 150 is deployed in this example.

Figure 4:
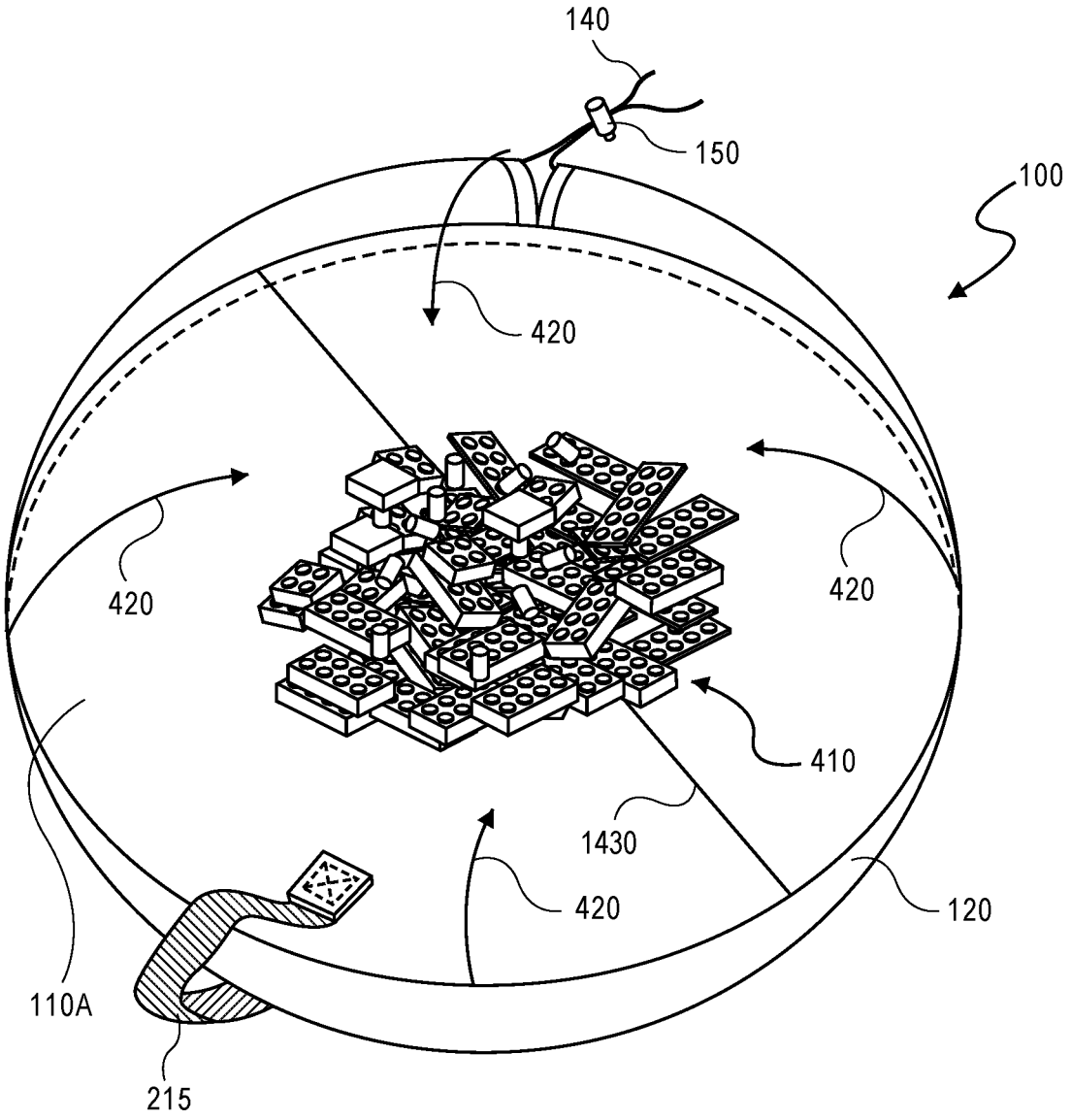
FIG. 4 is a perspective view of an example of a three-way convertible containment device in a mat configuration, consistent with embodiments of the invention.

FIG. 4 is a perspective view of an exemplary three-way convertible containment device 100 in a mat configuration, consistent with embodiments of the invention. In the view shown, items 410 are contained on the top surface 110A of base 110 by the lip 120 which rises substantially perpendicular to base 110. As noted above, in various embodiments, when deployed in a mat configuration, the height to which lip 120 rises above base 110 may vary at different points around the circumference of base 110, as lip 120 flexes, sags, or flops over. For example, in an embodiment where the maximum height of lip 120 is 3.5 inches, some portions of lip 120 may sag to a height of about 1.5 to 2 inches, while other portions stand at about 3.5 inches.

In the embodiment shown, convertible containment device 100 is opened or laid out on a horizontal surface to form a mat or work/play surface having a surrounding containment wall (lip 120). A user may easily spread out items 410, (e.g., various parts; pieces; toys; tools; balls; sporting equipment; knitting equipment; medical tools, supplies, and devices; electronic accessories and devices; cosmetics; travel items; fasteners; camping supplies; military supplies (e.g., stop-the-bleed kit, opioid overdose kit, and IFAK (individual first aid kit), survival kit); scuba-diving accessories, emergency survival items, etc.) on the upper surface or layer 110A of base 110, where they can be easily seen and utilized, for example to play or work with as an entire set. As shown, lip 120 stops items 410 from being pushed off of upper surface 110A of base 110 during use of items 410, which later enables a user to quickly and efficiently clean up and store items 410 by converting convertible containment device 100 into the closed, bag-like configuration while items 410 are contained on upper surface 110A of base 110.

Examples of activities involving numerous items 410 include traveling (e.g., items like cosmetics, toiletries, money, electronics, accessories, etc.), playing, repairing and other work, etc. Examples of items connected to playing include: Lego® brand building blocks, Lincoln Log® brand building sticks, Kynex® brand building blocks, Duplo® brand building blocks, Matchbox® brand toy cars, Hot Wheels® brand toy cars, Polly Pockets® brand figures, American Girl® brand doll sets, Barbie® brand dolls, Squinkies® brand figures, Playmobil® brand figures, wooden building blocks, action figures, Star Wars® brand action figures, Thomas and Friends® brand train toys, Littlest Pet Shop® brand toys, My Little Pony® brand toys, beads, crafts and art supplies, clay modeling, board games, train sets, dolls and doll accessories, stuffed animals, marbles, jacks, puzzles, building sticks, Play-Doh® brand modeling clays, etc. Examples of items connected to repairing and other work include: scale model tools and paints, electronics construction and repair tools and parts, mechanical construction and repair tools and parts, jewelry construction and repair tools and parts, etc.

The opening 1430 in the layer 110A of the base 110 is closed, such that it appears as a line or seam in the embodiment shown. In some embodiments, the opening 1430 may be implemented as a vent or a slit or the like, where the material on each side of the opening may not overlap. In other embodiments, the opening 1430 may be implemented as a placket or the like, where the material on each side of the opening overlaps with each. Other variations are possible. Some embodiments may employ fasteners for opening and securely closing the opening 1430.

Arrows 420 represent the motion of lip 120 when convertible containment device 100 is converted from the mat configuration to the bag configuration. In particular, a user may vertically lift and pull cinch cord 140 while items 410 are on top surface 110A of base 110, such that in the bag configuration top surface 110A becomes part of the inner surface of the bag, while bottom surface 110B becomes part of the outer surface of the bag. The lifting and pulling of cinch cord 140 causes the lip 120 and the peripheral edge of base 110 to raise and draw together as the portion of cinch cord 140 inside lip 120 becomes smaller, which forms convertible containment device 100 into a bag-like container or piece of luggage with items 410 inside. Once cinch cord 140 is drawn tight to form a bag of convertible containment device 100, the user may deploy cord lock 150 to lock in a position near lip 120, which prevents cinch cord 140 from entering the envelope formed by lip 120 and clamps shut the bag formed by convertible containment device 100.

In various embodiments consistent with the invention, the material that forms the lip 120, (and which envelopes cinch cord 140) may be any material that is flexible, thin, and non-binding to a degree that allows the material to be drawn together in a manner that leaves little or no opening in the bag when the cinch cord 140 is tightened to a large degree—i.e., when cinch cord 140 is used as a draw string to force lip 120 into a smaller annular shape. In one embodiment, 1.9 oz., calendared, rip-stop nylon material provides the appropriate characteristics of flexibility, thinness, and non-bindingness for lip 120. Other materials with similar properties may also be used within the scope of the invention.

The exemplary embodiment shown in FIG. 4 also includes a carrying strap 215, which may be formed of strong, flexible material, such as various types of fabric, and which is sewn, riveted, or otherwise attached to base 110. In various embodiments, carrying strap 215 may be constructed of nylon webbing material. The embodiment shown employs carrying strap 215 having a first attachment point (not shown) on bottom surface 110B of base 110 and a second attachment point opposite the first attachment point on top surface 110B of base 110. Thus, carrying strap 215 forms a loop and passes through an annular passage (e.g., annular passage 510 of FIG. 5) when convertible containment device 100 is in the bag configuration. The illustrated implementation of carrying strap 215 may be preferable to the implementation of carrying strap 210 (FIG. 2) where the length of carrying strap 210 is shorter than the length required to pass a person's arm through carrying strap 210 and comfortably sling convertible containment device 100 in the bag configuration over the person's shoulder.

In some other embodiments (not shown), there may be no cord 140 or cord lock 150, and instead the lip may include several magnets (e.g., cylindrical, permanent, rare-earth magnets of from about 1/16 to about 1 inch in diameter and about 1/16 to about 1/2 inch in height) that are sewn into or otherwise attached to or contained in specific areas of the lip 120, for example, inside of the envelope. In such embodiments, the lip 120 may be gathered by hand to convert the device 100 from the mat configuration to the bag configuration, and the magnets may attract to each other to keep the lip 120 in a gathered position so that the device remains in the bag configuration, similar to that shown in FIG. 5.

In some additional, similar embodiments, instead of permanent magnets, the lip 120 may be fitted and wired with electromagnets, a power source, and a switch. In such embodiments, the lip 120 may be gathered by hand to convert the device 100 from the mat configuration to the bag configuration, and the electromagnets may be switched on to attract to each other to keep the lip 120 in a gathered position so that the device remains in the bag configuration. In such embodiments, the bag may be automatically opened and at least partially converted back to the mat configuration by switching off the magnets and allowing gravity to pull the device into a position where the base 110 is partially or largely flat. Still other embodiments may have an electromagnetic closing mechanism in the lip 120, which, when switch on, at least partially gathers the lip 120 and at least partially reconfigures the device 100 into the bag configuration.

FIG. 5 is a side view of an exemplary three-way convertible containment device 100 in a bag configuration with the device 100 resting on flat surface, consistent with embodiments of the invention. In the embodiment shown, cinch cord 140 has been drawn to place convertible containment device 100 in a bag or luggage configuration and to essentially close or fully close an annular passage 510. In this configuration, bottom surface layer 110B of base 110 forms the lower portion of the outside of the bag or luggage. To maintain convertible containment device 100 in the illustrated bag or luggage configuration, a user may slide cord lock 150 to a position adjacent to lip 120 and adjacent to closed annular passage 510 (as shown), and secure cord lock 150 at that position. Locked cord lock 150 prevents any additional length of cinch cord 140 from entering the envelope formed by lip 120 and increasing the diameter or opening size of annular passage 510.

The tightening of cinch cord 140 draws together or gathers together the thin, flexible, non-binding (e.g., slippery) material of lip 120 so that annular passage 510 is essentially closed, at least to a degree that does not allow items 410 to pass through annular passage 510. In various embodiments, when the drawstring or cord 140 is pulled very tightly the annular passage becomes completely closed. In various embodiments, a thin, flexible, non-binding material is preferred for lip 120 because such material will gather, compact, and/or fold upon itself inside the loop formed by tightened cinch cord 140 and completely, or nearly completely, fill in and close annular passage 510, thus preventing small items 410 that are inside convertible containment device 100 from escaping from inside the bag configuration shown in FIG. 5.

In one embodiment, 1.9 oz., calendared, rip-stop nylon cloth provides the appropriate characteristics of flexibility, thinness, and non-bindingness for lip 120. Similar suitable materials may include 1.0 ounce nylon cloth; 1.1 ounce silicone impregnated nylon cloth; 3/4 ounce nylon spinnaker cloth, 1.1 ounce nylon parachute cloth, paraglider fabric, satin, and the like. Other materials with similar properties may also be used within the scope of the invention. Thicker, heavier materials, such as denim, canvas, large denier nylon, and the like, are not preferred for some embodiments of lip 120 because such materials will not gather, compact, and/or fold upon themselves sufficiently to completely, or nearly completely, close annular passage 510 when cinched into a relatively small annular shape by cinch cord 140.

In the illustration of FIG. 5, the device 100 in the drawstring bag configuration is approximately in the shape of a hemisphere. In FIG. 5, the device is resting on a flat surface, such as a table top, which imparts a flat side to the device 100, and creates the hemispherical shape, due to the flexibility of the materials forming the base 110 and the lip 120. One of ordinary skill will recognize however, that the device assumes a generally spherical shape when in the drawstring bag configuration while not resting on a flat surface and/or if not being affected by gravity.

Figure 6:
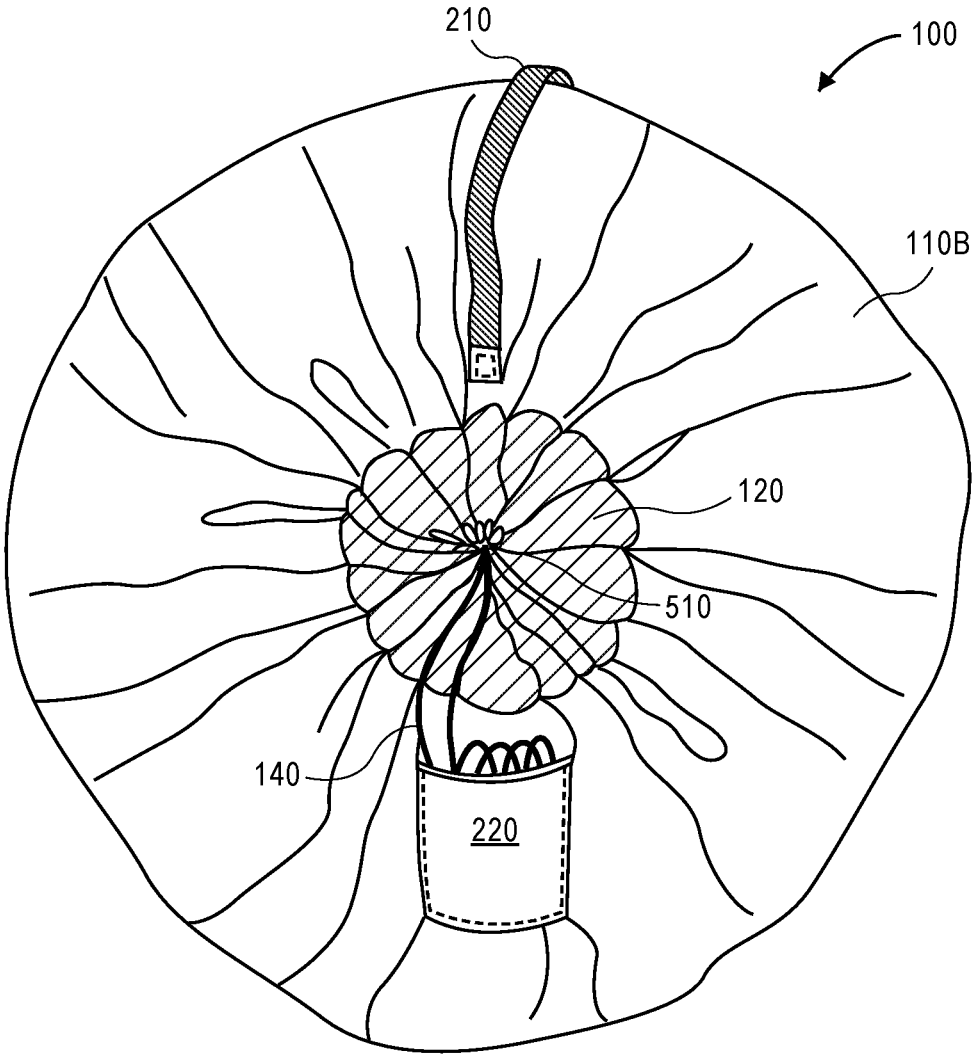
FIG. 6 is a top view of an example of a three-way convertible containment device in a drawstring bag configuration, consistent with embodiments of the invention.

FIG. 6 is a top view of an exemplary convertible containment device 100 in a bag configuration, consistent with embodiments of the invention. As shown, cinch cord 140 has been drawn to place convertible containment device 100 in a bag or luggage configuration and to essentially close annular passage 510. In FIG. 6, cord lock 150 is not shown, for clarity of illustration. Typically, for the closed configuration, cord lock 150 would be positioned adjacent to lip 120 and adjacent to closed annular passage 510, locking annular passage 510 in a drawn-closed position. As shown, the length of cinch cord 140 that was pulled out of the envelope formed by lip 120 to close convertible containment device 100 is stored inside of cord pocket 220. As shown in the view, the tightened cinch cord compresses the material of lip 120 inside annular passage 510 formed by the portion of cinch cord 140 that remains within the passage or envelope 710 formed in lip 120, which blocks and closes annular passage 510. As noted above, in various embodiments, the loose portion of cinch cord 140 may be placed completely inside cord pocket 220, and cord pocket 220 may be fastened closed using a Velcro® brand strip, button, snap, zipper, flap, or other closing means.

The embodiment of FIG. 6, also illustrates that carrying strap 210, which is attached to bottom surface 110B of base 110, is available for a user to grasp when convertible containment device 100 is in a bag or luggage configuration. A user may, for example, place carrying strap 210 over their shoulder to transport convertible containment device 100, with items 410 inside, to another location.

Figure 7:
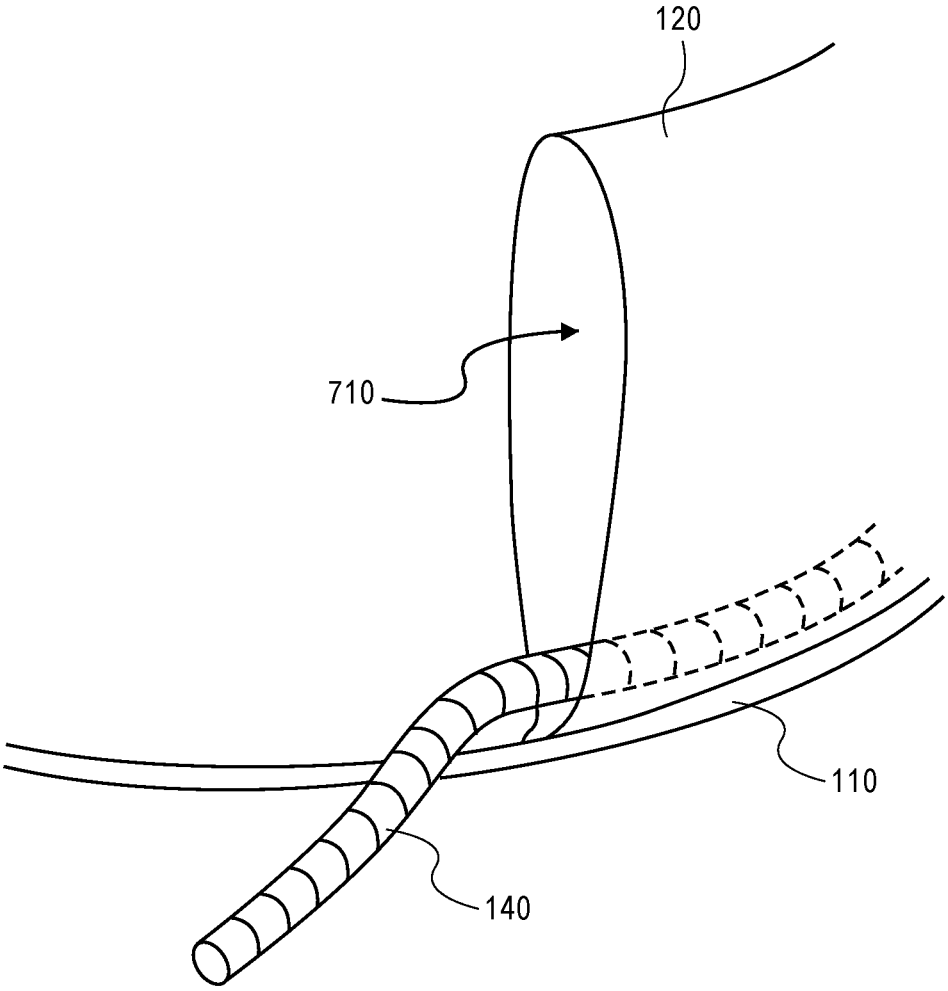
FIG. 7 is a detailed perspective view of an exemplary containment lip and drawstring of a convertible containment device, consistent with embodiments of the invention.

FIG. 7 is a detailed perspective view of an exemplary containment lip 120 and drawstring 140 of a convertible containment device 100, consistent with embodiments of the invention. As shown, lip 120 may be made of a flexible material that is doubled over or folded over and attached to base 110 in a manner that forms a hollow cavity, channel, or envelope 710, having openings at each end. In various embodiments, cinch cord 140 may be run through envelope 710, so that cinch cord 140 surrounds base 110 when convertible containment device 100 is open and laid out in the mat configuration, and so that cinch cord 140 may be drawn or slid through and out of openings in envelope 710 to form a bag with an annular passage 510.

In some embodiments (not shown), envelope 710 may be divided into two or more smaller envelopes, for example by stitching or otherwise lengthwise joining together the walls of envelope 710. In such embodiments, cinch cord 140 may pass through one of the smaller envelopes. For example, in the case where envelope 710 is divided into two smaller envelopes, cinch cord 140 may pass through the lower small envelope, which is adjacent to base 110, in order to enhance the standing up of lip 120 when convertible containment device 100 is in the mat configuration. For another example, in the case where envelope 710 is divided into three smaller envelopes, cinch cord 140 may pass through the middle small envelope, which is removed from base 110 by a lower envelope, in order to enhance the cinching and closing of annular passage 510 when convertible containment device 100 is in the bag or luggage configuration.

In other embodiments (not shown), envelope 710 may be empty, or envelope 710 may be nonexistent for embodiments where the material forming lip 120 is not folded over. In such embodiments, cinch cord 140 may be attached to the outside of lip 120 using loops (e.g., similar to belt loops) or other means of slidable attachment that allows lip 120 to be cinched closed in the bag configuration. In still other embodiments, cinch cord 140 may be replaced by another closing mechanism, such as a clamp (e.g., similar to one half of a pair of handcuffs, similar to a tightening or ratcheting strap as found on a ski boot, or similar to a locking wood clamp, and the like) that is clamped on the outside of, and squeezes together, the folds of lip 120 after a user has gathered the folds together by hand to form a bag configuration. In such embodiments, the clamp may be stored in outside pocket 220 when convertible containment device 100 is in the mat configuration.

Figure 8:
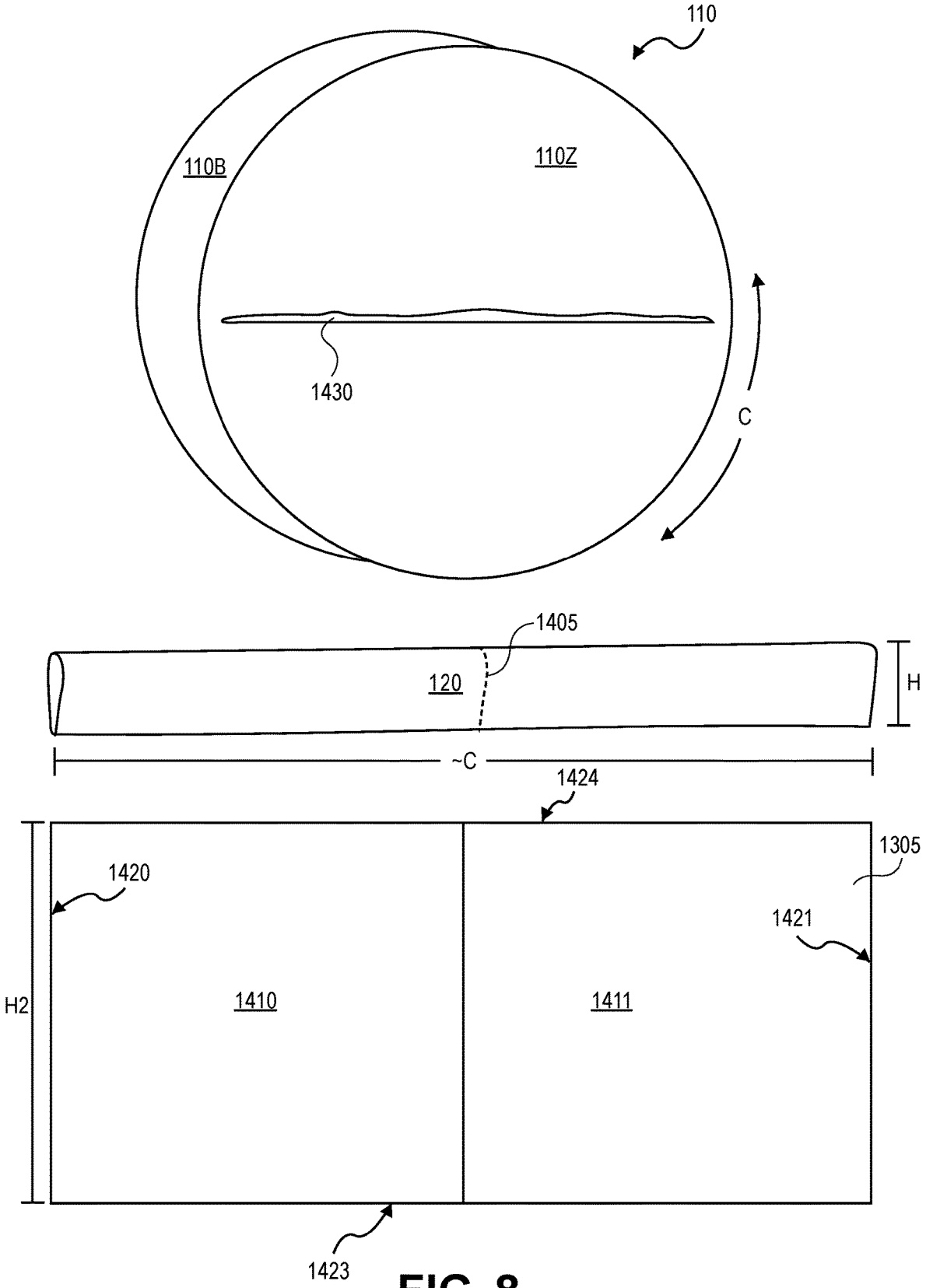
FIG. 8 is a view of exemplary components of a convertible containment device, consistent with embodiments of the invention.

FIG. 8 is a view of exemplary components for a three-way convertible containment device, consistent with embodiments of the invention. In the example shown, base 110 has a circular shape with a diameter D and a circumference C. The embodiment of a base 110 shown in FIG. 8 includes two components, pieces, or layers 110B and 110Z, which are stacked on each other when assembled. In various embodiments, the diameter of base 110 may be in the range of about 6 inches to about 120 inches or larger, including embodiments of 18 inches, 20 inches, 22 inches, and 60 inches. The circumference C for a given diameter D may be calculated using the well-known formula $C=\pi D$.

Layer 110Z of the base 110 that includes an opening 1430, which allows access to the space between layer 110B and layer 110Z, and which may be formed or implemented in different ways in different embodiments. In the example shown, the layer 110Z includes a hole or slit 1430 in a single piece of material that forms the layer 110Z. In other implementations, the layer 110Z may be formed by joining or attaching (e.g., using stitches) multiple pieces of material (e.g., fabric) together in a manner that leaves an opening similar to opening 1430. For example, two or more pieces of material may be stitched together to form a placket, vent, or the like which allows access to the space between layer 110B and layer 110Z. For instance, for a vent, two semicircular pieces of material may be used, and for a placket, two larger-than-semicircular pieces of material may be used. Other variations are possible. In some embodiments, the opening 1430 may be fitted with one or more fastener, such as a zipper 180, buttons, a hook and loop strip(s), or the like, to make the opening 1430 sealable and unsealable. Although the embodiment of FIG. 8 shows the opening 1430 spanning almost the entire diameter of the layer 110Z of the base 110 (e.g., spanning greater than 90% of the diameter), other embodiments may include an opening 1430 that is smaller, such as an opening 1430 that has a length that is from about 15% to about 89% of the longest dimension (e.g., the diameter for a circle) of the base 110.

In the example shown, lip 120 has a folded-over rectangular shape with a length approximately equal to the circumference C of base 110. In various embodiment, the approximately length of lip 120 may be a longer or shorter than C. In some embodiments, variations from length C may be needed to facilitate attaching lip 120 along the periphery of base 110, or to facilitate multiple openings for multiple cinch cords or drawstrings, among other things. As shown, lip 120 also has a height dimension H. In various embodiments, the height of lip 120 may be in the range of about 1 inch to about 5 inches or larger, including embodiments of 1.5 inches and 3.5 inches.

In some embodiments, making the length of lip 120 approximately equal to C, and/or attaching lip 120 to base 110 so that the effective length of lip 120, without counting overlap, is approximately equal to C, creates a structure that urges lip 120 to rise or stand up in a vertical direction when base 120 is spread out flat on a horizontal surface, such as a floor or table. In some embodiments, lip 120 may be made of more than one piece, each piece having a length that together making the overall length of lip 120 approximately equal to C. Such embodiments may have multiple openings in the envelope 710, from which a cinch cord 140 may emerge. In some embodiments, the length of lip 120 may be slightly greater than C while still being approximately equal, for example up to about 5% greater than C (such as 1%, 2%, 3% or 4% greater), or from about one-half inch to about one inch greater than C, such that the ends of lip 120 overlap to some degree when attached to base 110, reducing or eliminating space(s) between the ends of lip 120 when attached to base 110. In some other embodiments, the length of lip 120 may be less than C while still being approximately equal, for example up to about 20% less than C, (such as 1%, 2%, 3%, 5%, 7%, 10%, 14%, 17%, or 22% less), or from about one-quarter inch to about six inches shorter than C, such that the ends of lip 120 are separated to some degree when attached to base 110, leaving space(s) between the ends of lip 120 when attached to base 110.

FIG. 8 also shows one example of an optional dividing line 1405 on the lip 120, wherein the dividing line 1405 indicates where the lip 120 could be cut into, divided into, or implemented as two separate pieces. In embodiments where the lip 120 is implemented as two separate pieces, the pieces may be attached to the base 110 with a space or gap between them to allow access to one or more cords 140 and the total length of the pieces may be less than the circumference C of the base 110. In various embodiments, the total length of the pieces of the lip 120 may be approximately equal to the circumference C of the base 110, as shown. In some embodiments, the total length of the pieces of the lip 120 may be from about 5% more about 20% less than the circumference C of the base 110. Although not shown in the example of FIG. 8, other embodiments may have more than one dividing line 1405, such that the lip 120 could be cut into, divided into, or implemented as three or more separate pieces, which may be attached to the base 110 with or without spaces between them, and/or which may be sewn together to form longer envelopes.

FIG. 8 also shows an example of material used to make the wall of a large volume, cylindrical-shaped bag 1305. In the example shown, the material for the bag 1305 has a rectangular shape with a length approximately equal to the circumference C of base 110. In various embodiment, the length of the material for the bag 1305 may be a longer or shorter than C. In various embodiments, variations from length C may be needed to facilitate attaching the bag 1305 to the base 110, among other things. For example, variations from length C may depend on how close the length edge of the bag 1305 is attached to the periphery of the base 110. For instance, the material for the bag 1305 may be of approximately length C, or a little longer, (e.g., up to +5% longer), if attached at or near the periphery, or it may be less than length C, (e.g., up to −10% shorter), in embodiments where it is attached inboard of the periphery.

As shown, the material for the bag 1305 also has a height dimension H2. In various embodiments, the height H2 of the bag 1305 may be in the range of about 4 inches to about 48 inches or larger, including embodiments of 12 inches, 15 inches, 16 inches, 18 inches, and 27 inches, among others.

Although the embodiment of FIG. 8 is described using circular base 110 as an example, corresponding principles apply when base 110 is shaped as an ellipse that is not a circle, an oval, a polygon, or the like. Further, embodiments that use a circular base 110 as shown in the example of FIG. 8 form a cylindrical-shaped or cylinder-like bag when the material for the bag 1305 is attached (e.g., stitched) on or near the perimeter of the circular base 110, but it should be noted that other embodiments may use other shapes for the base 110, such as a non-circle ellipse, oval, or polygon (e.g., square, hexagon, octagon, dodecagon, irregular polygon, etc.), and the resulting shape the of the bag formed by the base 110 and the bag wall 1305 will not be precisely, or even nearly (e.g. a square base would result in a cuboid-shaped bag), cylindrical, but can still be referred to herein as an approximately cylindrical bag or a cylindrical-shaped bag.

In the example shown in FIG. 8, the bag 1305 is formed of two pieces, portions, or panels of material: a first, left piece 1410 and a second, right piece 1411, which are attached or joined together, for example using stitches of thread. In other embodiments, the bag wall 1305 may be formed of a single piece of material, or the bag wall 1305 may be formed of more than two pieces of material that are joined together. In some embodiments, the overall shape of the bag 1305, whether or not composed of multiple pieces 1410, 1411, may be trapezoidal instead of rectangular as shown in FIG. 8, such that when deployed in the approximately cylindrical bag configuration (e.g., for use as a shopping bag), the bag has the approximate form of a truncated cone or an inverted truncated cone.

In various embodiments, when assembled with the base 110 to form an approximately cylindrical bag, the left edge 1420 of the material of the bag 1305 is attached or joined to the right edge 1421 of the material of the bag 1305 (e.g., by stitching or adhesive or the like) and the bottom edge 1423 of the material of the bag 1305 is attached or joined to the base 110, for example, at or near the periphery or perimeter of the base 110. The top edge 1424 of the bag 130 forms the rim of the opening of the approximately cylindrical bag when the device 100, 1100 is in the approximately cylindrical bag configuration.

In some embodiments, the bottom edge 1423 of the material of the bag 1305 may attached or joined inboard from or inside the periphery or perimeter of the base 110, such as from about one-quarter inch to about six inches inboard of the perimeter of the base 110 or from about 1/15 to about 1/4 of the base's diameter inboard. As one example, if the diameter of a circular base 110 is 20 inches, then the bottom edge 1423 of the bag 1305 may be attached two inches (or 1/10 of the base's diameter) inboard of the base's perimeter, such that the circular bottom of the cylindrical-shaped shopping bag has a diameter of 16 inches. Other variations and example are possible. In such embodiments, the length of the bottom edge 1423 of the bag 1305 may be less than the circumference C of the base 110.

In various embodiments, the bag 1305 may be formed of one layer of material (as shown) or may be formed of two or more layers of material, which may be attached to each other by stitches, adhesive, or the like.

As described elsewhere herein, the three-way convertible containment device may include other components that are not shown in the example of FIG. 8, such as a cord(s), a cord lock(s), a pocket(s), a handle(s), a device carrying pouch, etc.

Figure 9:
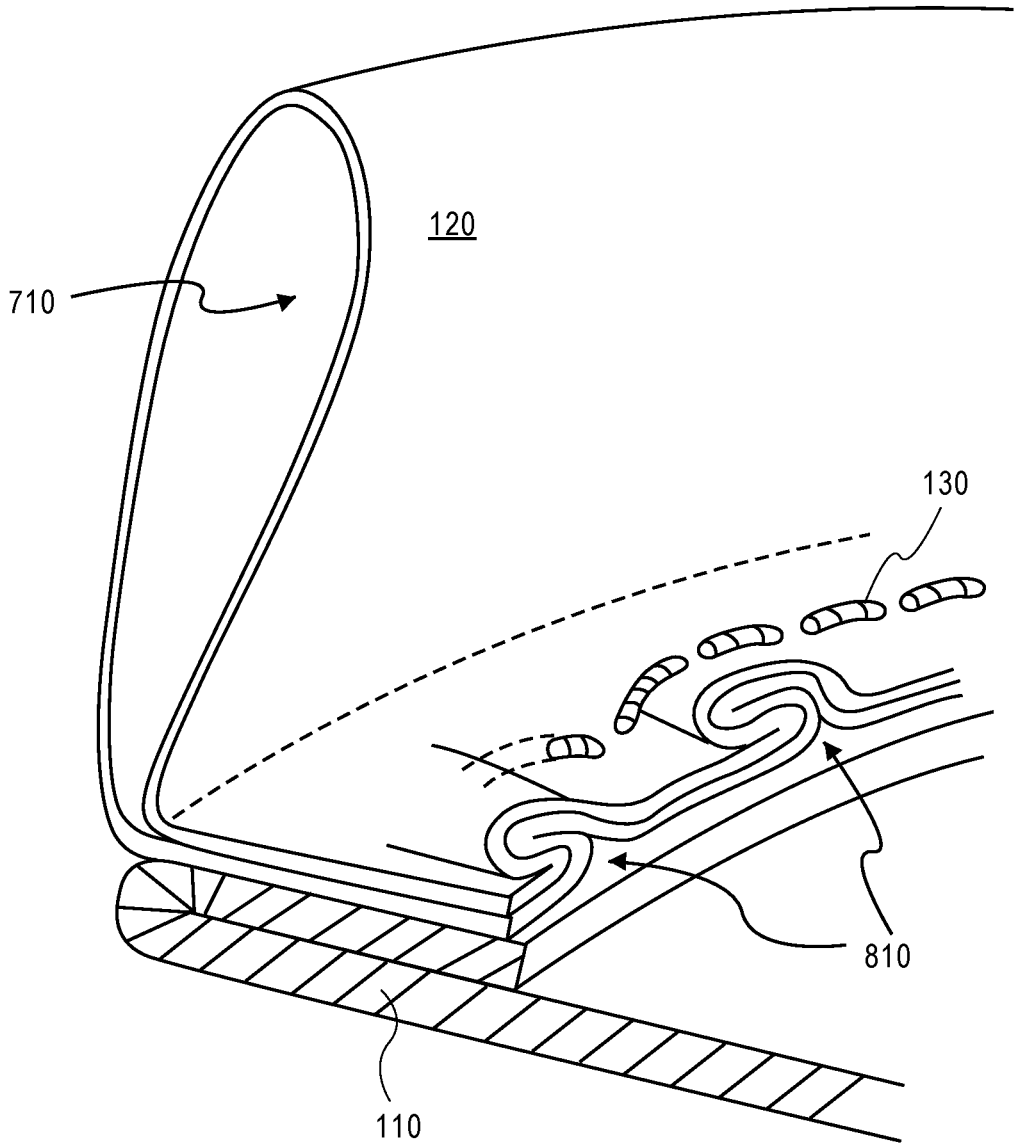
FIG. 9 is a detailed perspective view of an exemplary attachment between a containment lip and a layer of a base of a convertible containment device, consistent with embodiments of the invention.

FIG. 9 is a detailed cut-away perspective view of an exemplary attachment between a containment lip 120 and a layer of a base 110 of a convertible containment device 100, consistent with embodiments of the invention. In the example shown, lip 120 is attached to base layer 110 using gathers or pleats 810 secured by stitches 130. In this embodiment, pleats 810 allow the straight edge of lip 120 to be attached to the curved or multi-angled periphery of base 110, and provide structure and static forces which urge lip 120 to rise or stand approximately perpendicular to base 110.

In the embodiment shown, the layer of base 110 is folded over at the periphery to provide a more substantial anchor for stitches 130. In other embodiments, base 110 may not include this fold. For clarity, this illustration shows only a single layer or piece of material for base 110. In various embodiments as described herein, however, base 110 may be formed of multiple pieces or layers. In some of these embodiments a second layer of base material may be placed over pleats 810 before stitching, such that pleats 810 are sandwiched between two base pieces or layers. In yet other embodiments, a similar sandwiching arrangement that includes a third piece of padding or other material may be used to form base 110.

Attachment means other than stitches 130, such as glue, heat welding, rivets, etc. are within the scope of the invention. In some embodiments, serge stitching or overlocking stitching may be used to attach lip 120 to base 110.

In some embodiments, base 110 and lip 120 may be formed of a single piece of thin flexible material (not shown). In such embodiments, the folded over edge of the single piece may be formed into pleats or gathers, similar to pleats 810, so as to urge the portion of the single piece forming the envelope to rise approximately perpendicular to the portion of the single piece forming the base.

Although the example illustrated in FIG. 9 shows pleats 810 as gathering enough material of lip 120 to fold over, in other implementations pleats 810 may gather in a lesser amount of material that is insufficient to fold over as shown, but which instead forms a smaller single fold in a substantially perpendicular orientation to base 110 or forms ripples in the lip material, where the ripples do not include folds. These single-fold and ripple implementations may be more desirable in embodiments where base 110 has a diameter of about two feet or larger. Other implementations are possible within the scope of the invention.

Figure 10:
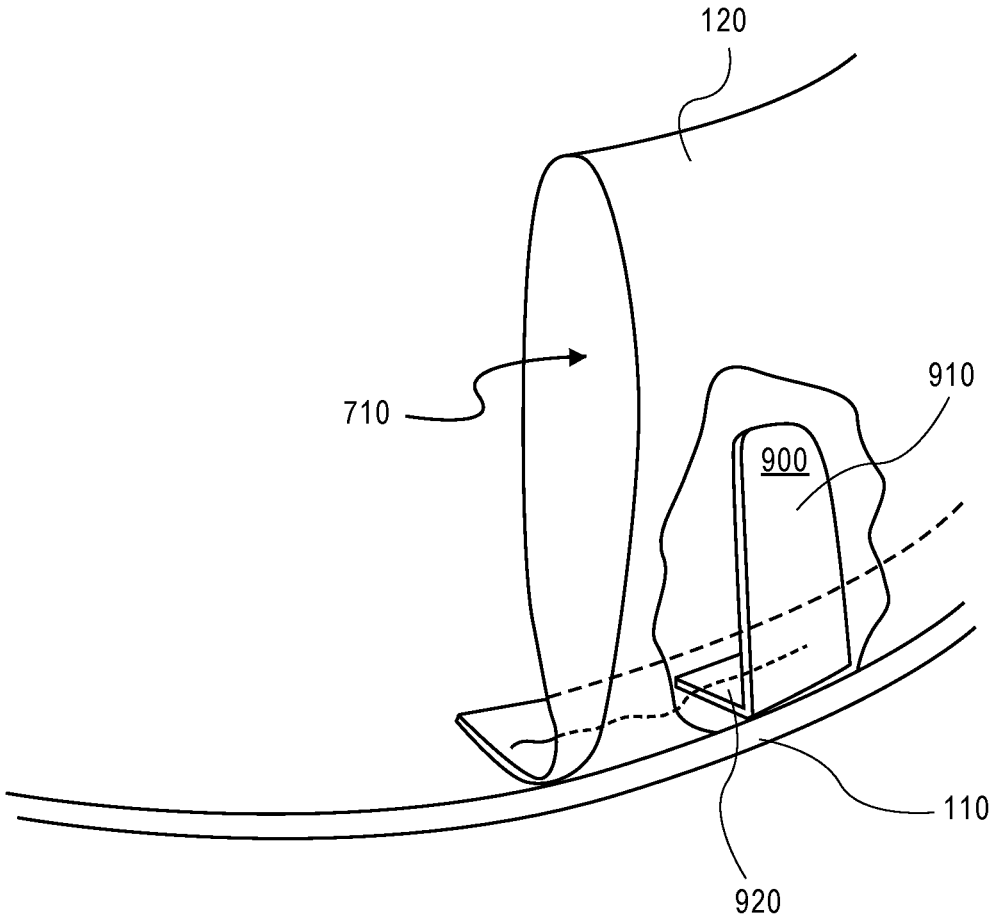
FIG. 10 is a detailed perspective view of an exemplary containment lip with support member of a convertible containment device, consistent with embodiments of the invention.

FIG. 10 is a detailed cut away perspective view of an exemplary containment lip 120 with a support member 900 for a convertible containment device 100, consistent with embodiments of the invention. In the embodiment shown, envelope 710 formed by lip 120 contains a support member 900 that cause at least a portion of lip 120 to stand up from or rise approximately perpendicular to base 110. As shown, support member 900 may be "L" shaped, with a first leg 920 of support member 900 sewn or otherwise attached to base 110 such that a second leg 910 of support member 900 stands substantially perpendicular to the base 110, holding up at least a portion of lip 120. In some embodiments, the length of the second leg 910 may be approximately half the height of lip 120, or shorter, to avoid interfering with the gathering of the top edge of lip 120 when cinch cord 140 (not shown) is tightened to close convertible containment device 100 into a bag configuration.

In some embodiments, support member 900 may be formed of a somewhat stiff yet pliable material, such as vinyl plastic or the like. In other embodiments, support member 900 may be formed of other materials that provide structure to cause lip 120 to stand up, such as wire, sections of thick fabric (e.g., ballistic nylon), leather, and the like.

In various embodiments, several support members 900 may be placed within envelope 710 at spaced intervals (not shown) around the periphery of base 110. For example, support members 900 may be spaced from about 6 inches to about 18 inches apart around the periphery of base 110. In some embodiments, the distance between support members 900 may be at least 8 inches to avoid interfering with the gathering of lip 120 when cinch cord 140 (not shown) is tightened to close convertible containment device 100 into a bag configuration.

One advantage, among several, of the disclosed convertible containment device is that various embodiments provide an easily storable and transportable shoulder satchel, bag, or knapsack that converts into a mat and that is structured to securely contain large and small items both in the open, mat position and in the closed bag/satchel/knapsack position. Various embodiments allow users, including children of appropriate age, to quickly and efficiently clean up pieces, parts, components, etc. that are laid out and/or used on the open mat. Various embodiments also assist a Warfighter in Expeditionary Advanced Base Operation (EABO) efforts, such as by enabling rapid deployment, containment, and packing of Warfighter items and materials.

For clarity, FIG. 10 shows only a single layer or piece of material for base 110, but in various embodiments as described herein, base 110 may be formed of multiple pieces or layers.

Figure 11:
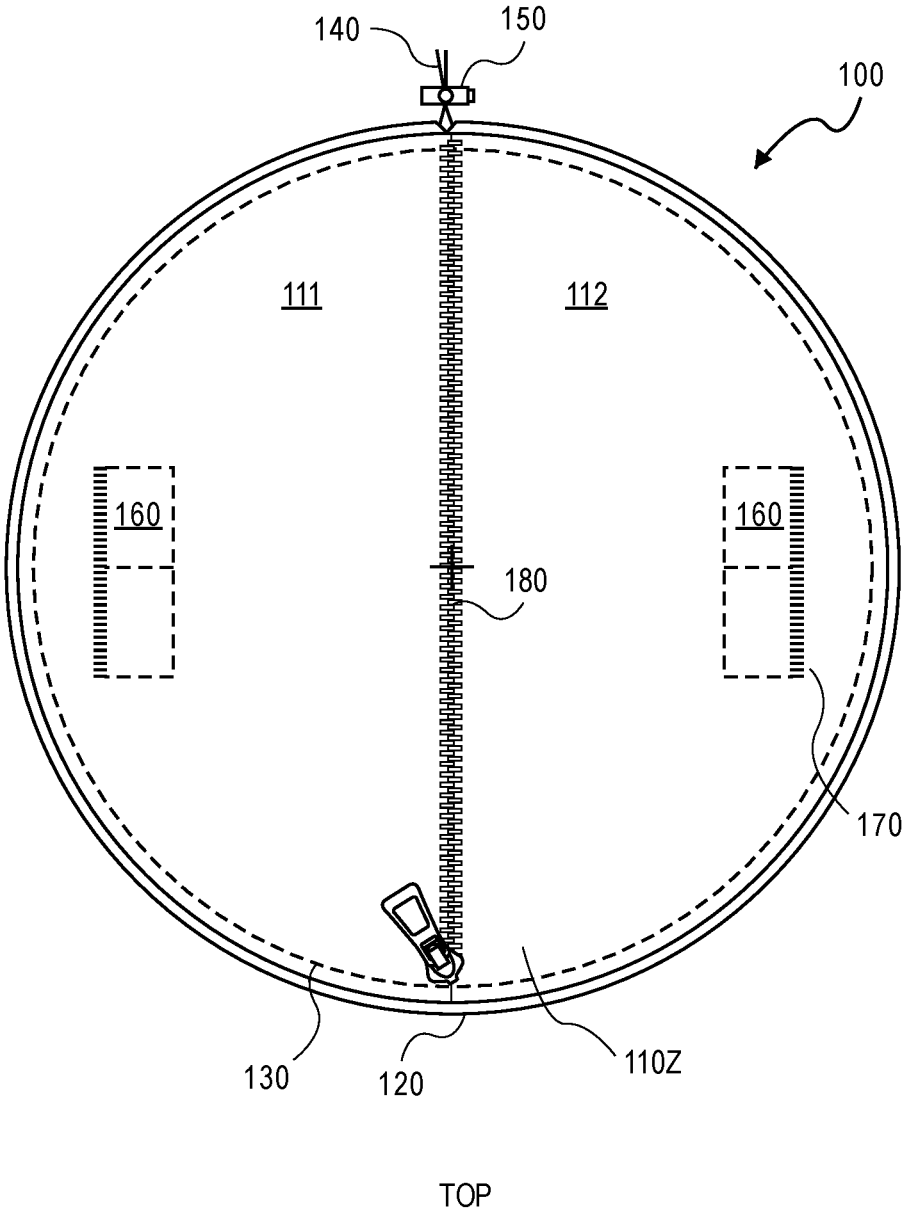
FIG. 11 is a top view of an example of a three-way convertible containment device in a mat configuration, consistent with embodiments of the invention.

FIG. 11 is a top view of an example of a three-way convertible containment device 1100 in a mat configuration, consistent with embodiments of the invention. In the example shown in FIG. 11, the three-way convertible containment device 1100 is spread out in a mat or work surface configuration and shows the top side or top layer 110Z of the base 110. The top layer 110Z of the base 110 includes a fastener or fastening means, in this example a zipper 180, for an opening 1430 in the layer 110Z, which enables a user to seal and unseal (e.g., fasten and unfasten) the opening 1430. The zipper 180 has two pull tabs; one is shown in FIG. 11, and the other is opposite the one shown, under the layer 110Z and in between the layers 110Z, 110B of the base 110. Two pull tabs are desirable because the base 110 is turned inside out during use when converting the device 100, 1100 from one configuration to another. The layer 110Z may also be referred to as the zipper layer 110Z in this embodiment.

In various embodiments, the base 110 may be elliptical, circular (as shown), or oval in shape, or approximations thereof. In some embodiments, base 110 may be in the shape of a polygon, such as an equilateral, cyclic polygon having four or more sides, e.g., a square, a hexagon, an octagon, etc., or an irregular polygon. Other embodiments of base 110 may be in the shape of a many-sided polygon that approximates an elliptical or oval shape, e.g., a dodecagon, an elongated dodecagon shape, etc. In various embodiments, the diameter or longest dimension of base 110 may be in the range of about 6 inches to about 120 inches or larger, including embodiments of 12 inches, 13 inches, 16 inches, 18 inches, 20 inches, 22 inches, 24 inches, and 60 inches, among others.

In some embodiments, base 110 may be formed of two or more pieces or layers of flexible material, such as denim, suede, leather, velvet, canvas, cotton twill, polyester including large denier polyester, nylon including large denier nylon, ballistic nylon, ripstop nylon, nylon mesh fabric, sail oxford ripstop nylon, Cordura™ brand fabric, packcloth, recycled material, or the like. In some other embodiments, base 110, or one or more layers thereof, may be formed of a lightweight flexible material, such as 1.9 oz calendared rip-stop nylon material, polyester, microfiber fabric, taffeta fabric, or the like. In some embodiments, one or both of the zipper layer 110Z and the bottom layer or surface 110B (see FIG. 2) of base 110 may be formed of a lightweight flexible material, such as 1.9 oz calendared rip-stop nylon or polyester material, to provide a work or play surface having specific desired qualities, such as being waterproof, stain resistant, pleasant to touch, colorful, easily able to custom print, etc. In some embodiments, bottom surface 110B (not shown in FIG. 11) of base 110 may be formed of a relatively heavyweight flexible material, such as 10 oz cotton denim fabric or ballistic nylon (e.g., 1000 denier ballistic nylon) or the like.

In some embodiments, as shown in FIG. 11, the layer 110Z of the base 110 may be formed of two (or more) pieces 111, 112 of flexible material that are configured to form an opening 1430, which is closable by the zipper 180; while in other embodiments, the layer 110Z may be single piece of material with a slit or the like in it, which forms an opening 1430 that accommodates the zipper 180. The zipper 180 is just one type of fastener that may be used.

In the example shown in FIG. 11, each of the pieces 111, 112 of the zipper layer 110Z is approximately the shape of a semicircular. In some similar other embodiments, the pieces 111, 112 may both be smaller than a semicircular (i.e., may be less than half the size of the circular base 110), which may be desirable to provide space or gap, which may be taken up by a zipper 180 in some embodiments. In still other embodiments (not shown), one piece 111 may be larger than a semicircle, and the other piece 112 may be smaller than, larger than, or the same size as a semicircle. In some such embodiments where piece 111 is larger than a semicircle, the piece 111 may overlap the piece 112, for example in placket-like arrangement, and a fastener other than a zipper 180 (e.g., button(s), snap(s), hook and loop strip(s), etc.), may be employed to seal and unseal the opening 1430 between the pieces 111, 112. In some other embodiments, no fastener at all may be employed.

In other embodiments in which the base 110 is not in the shape of a circle, the pieces 111, 112 of the layer 110Z may be in the form of half, or approximately half of the base's shape; for example, one-half of an ellipse, one-half of a polygon, (e.g., one-half of a hexagon), and the like. In still other embodiments one piece 111 may be larger than half of the base shape, and the other piece 112 may be smaller than, larger than, or the same size as one half of the base shape.

In various embodiments, the separation, gap, slit, or opening 1430 in the base layer 110Z (e.g., where the zipper 180 lies in FIG. 11) may be off center or not in the middle of the base 110, such that the pieces 111, 112 are not the same size and/or shape. In various embodiments, the opening 1430 and/or the zipper 180 may be curved or otherwise non-linear.

In some embodiments, the layer 110Z of the base 110 may be formed of more than the two pieces 111, 112, shown in the example of FIG. 11, and some of those pieces may be joined to each other by stitching or the like, and/or a fastener, such as the zipper 180. As noted, in various embodiments, the layer 110Z (and/or the bottom layer 110B, or both) may have one (or more) opening 1430 (e.g., a slit, vent, placket or the like), which may or may not include a fastening or closing means or device, (e.g., a zipper 180, hook and loop strips, buttons, snaps, or the like). Regardless of how configured, the opening 1430 allows access to the space or area in the base 110 between the layer 110Z and the layer 110B, such that the cylindrical-shaped bag 1305 may be placed or folded into the space between the layers of the base 110, e.g., when the cylindrical-shaped bag 1305 is not in use.

As shown in FIG. 11, a lip 120 is attached to the perimeter of base 110 in a manner that causes at least a portion of lip 120 to stand substantially perpendicular to base 110 when base 110 is spread out on a substantially horizontal surface. In the configuration shown, the lip 120 forms a wall or barrier around the zipper layer 110Z, and acts to contains any items, parts, or pieces placed on top surface 110A while a user utilizes the items, parts, or pieces. See, for example FIGS. 3 and 4.

In various embodiments, lip 120 stands up substantially perpendicular to base 110 due at least in part to the configuration of lip 120, e.g., its dimensions, such as vertical height above horizontal base 110, and its connection to the circumference or periphery of the base 110, and its folded form in certain embodiments. In some embodiments, lip 120 stands up substantially perpendicular to base 110 due at least in part to its fabrication from lightweight flexible material, such as 1.9 oz calendared rip-stop nylon material or a light polyester material, including its fabrication from a material that is more flexible and lower in weight and density compared to a thicker, more rigid material (e.g., 10 oz. denim) that forms base 110. In some embodiments, lip 120 stands up substantially perpendicular to base 110 due at least in part to its method or implementation of attachment to base 110. In some embodiments, lip 120 stands up substantially perpendicular to base 110 due at least in part to the elliptical, oval, or polygonal shape of base 110. In some embodiments, lip 120 stands up substantially perpendicular to base 110 due at least in part to the presence of a particular length of string or cord inside an envelope formed by lip 120. In some embodiments, lip 120 stands up substantially perpendicular to base 110 due at least in part to a separate stiffening structure such as perpendicular support members attached to the base 110 and situated inside an envelope formed by lip 120.

As shown in the embodiment of FIG. 11, lip 120 may be attached to base 110 by stitches 130. In various embodiments, lip 120 may be configured (e.g., folded over) to form a channel or envelope through which a cinch cord 140 may pass. In various embodiments, cinch cord 140 may be pulled to change convertible containment device 1100 from the open flat configuration shown into a closed bag-like configuration (as shown in FIG. 5). In the embodiment shown, cinch cord 140 comes out of adjacent openings of the envelope formed by lip 120 at a single point of the periphery of base 110. As shown in FIG. 11, cinch cord 140 may also pass through a cord lock 150, which may be adjustably employed to clamp and maintain convertible containment device 1100 in a closed bag-like configuration. In other embodiments (not shown), there may be multiple openings in the lip 120 (e.g., two openings, one at each end of a diameter line across the base) and the cinch cord 140 may come out of the multiple openings and may have multiple cord locks 150, and/or there may be two or more cinch cords 140, each having a cord lock 150. In some embodiments, cinch cord 140 may be constructed of 3 mm or 5 mm climbing cord.

In the embodiment shown in FIG. 11, the zipper layer 110Z of base 110 includes pockets 160, which may be formed of flexible material, such as various types of fabric, including for example see-through vinyl plastic, that is sewn or otherwise attached to base 110. Pockets 160 may be used to contain and separate chosen items from other items contained in convertible containment device 1100, especially when convertible containment device 1100 is in a bag-like luggage configuration. In the embodiment shown, pockets 160 may use zippers 170 to open and close the pocket opening. In other embodiments, buttons, Velcro® brand hook and loop strips or other closure means may be used to prevent any contents of pockets 160 from leaving interior pockets 160. The dimensions, and even the presence, of pockets 160 are not critical. As an example, in an embodiment where the diameter of base 110 is about 60 inches, the dimensions of pockets 160 may be about 6 inches by about 14 inches.

As previously mentioned, in the embodiment shown in FIG. 11, the layer 110Z of base 110 includes an opening 1430, (in this instance fastened by the zipper 180), that provides access to the space between the zipper layer 110Z and the bottom surface or layer 110B of the base 110. As will be explained below, the space between the zipper layer 110Z and the bottom surface 110B may be used to contain additional flexible components (e.g., components made of fabric or a like material) that can be configured to form an approximately cylindrical bag out of the containment device 1100, while maintaining the structure and ability to also convert the device into a containment mat configuration (e.g. as shown in FIG. 4) and into an approximately spherical, drawstring bag configuration (e.g. as shown in FIG. 5). In some other embodiments (not shown), the opening 1430 and the zipper 180 may be included in the bottom surface 110B of the base 110. Still other embodiments may include openings 1430 in both the layer 110Z and the bottom layer 110B of the base 110. As previously noted, the opening(s) 1430 may be closable by means other than a zipper 180, including, for example, devices such as a hook and loop strip, a plastic zip lock, buttons and button holes, and the like; or there may be no means or device included to close the opening 1430, in some embodiments.

Figure 12:
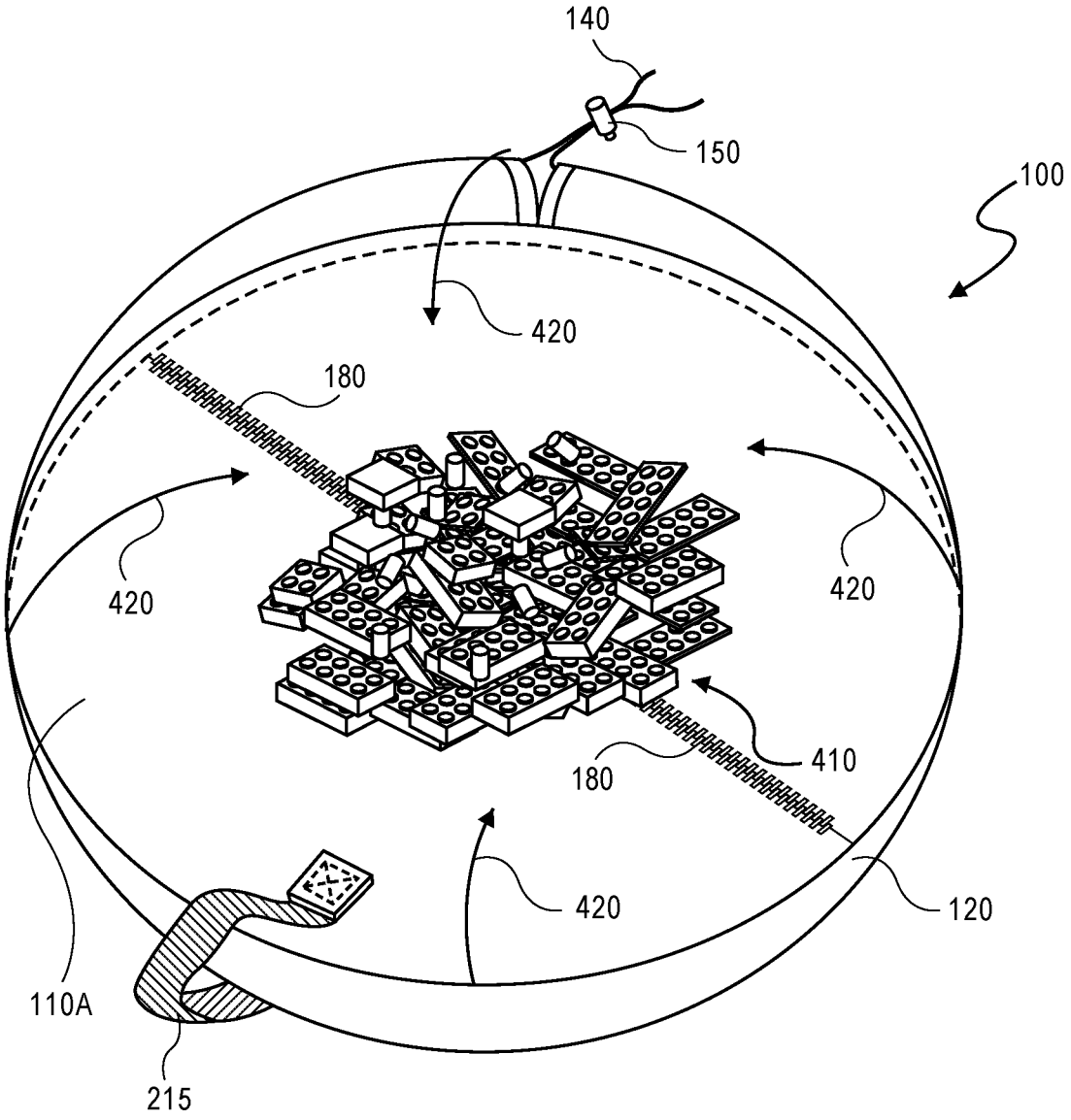
FIG. 12 is a perspective view of an example of a three-way convertible containment device in a mat configuration, consistent with embodiments of the invention.

FIG. 12 is a perspective view of a three-way convertible containment device 1100, 100 in a mat configuration, consistent with embodiments of the invention. In this figure, the zipper 180 that opens and closes the opening 1430 in the layer 110Z of the base 110 is in the closed or zipped-up position. In the configuration shown, items 410 are contained on the zipper layer 110Z of base 110 by the lip 120 which rises substantially perpendicular to base 110. As noted above, in various embodiments, when deployed in a mat configuration, the height to which lip 120 rises above base 110 may vary at different points around the circumference of base 110, as lip 120 flexes, sags, or flops over. For example, in an embodiment where the maximum height of lip 120 is 3.5 inches, some portions of lip 120 may sag to a height of about 1.5 to 2 inches; and in an embodiment where the maximum height of lip 120 is 1.5 inches, some portions of lip 120 may sag to a height of about 0.5 to 1 inch. In most respects other than the zipper 180, this view is similar to that described above with respect to FIG. 4.

Figure 13:
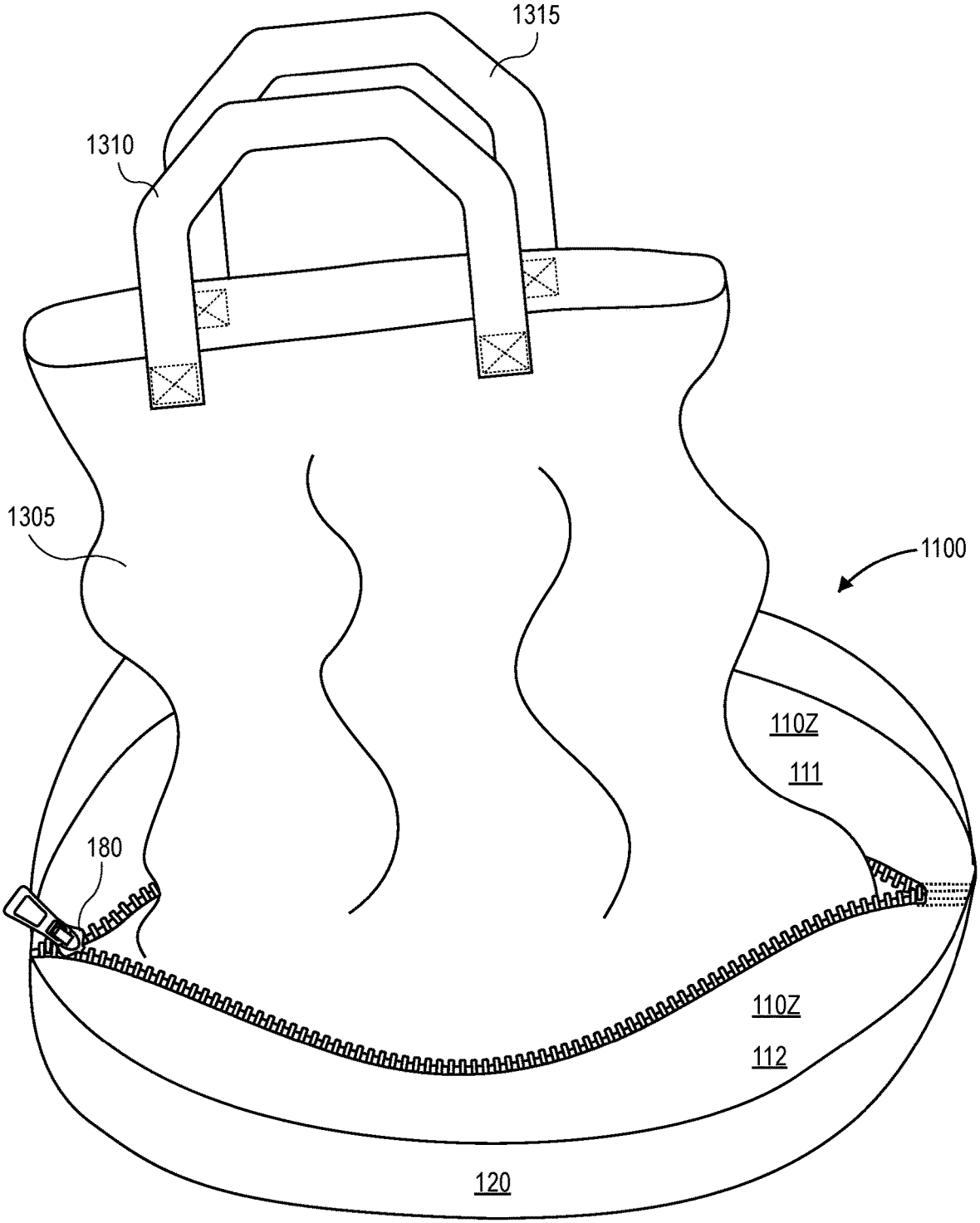
FIG. 13 is a perspective view of an example of a three-way convertible containment device showing the partial deployment of a large-volume bag (e.g., a cylindrical-shaped bag), which was stored between the layers of the base.

FIG. 13 is a perspective view of an example of the three-way convertible containment device 1100, 100 showing the partial deployment of a bag 1305, which was flattened or folded and tucked or otherwise stored between the zipper layer 110Z of the base 110 and the bottom surface layer 110B of the base 110 when the zipper 180 was closed, as shown in FIGS. 11 and 12. In various embodiments, the wall of the bag 1305 may be formed of one, two or more pieces or layers of flexible material, such as canvas, cotton fabric, polyester, nylon, ballistic nylon, ripstop nylon, ripstop polyester, mesh or net fabric (e.g., nylon mesh), packcloth, non-woven material, recycled material, and the like. In some embodiments, the approximately cylindrical bag 1305 may be formed of a lightweight flexible material, such as 1.9 oz calendared rip-stop nylon material or fabric, microfiber fabric, nonwoven plastic material, taffeta fabric, 1.9 oz polyester fabric, or the like.

In various embodiments, one end (e.g., the bottom edge 1423) of the wall of the bag 1305 is attached to the base 110, for example, using stitching, adhesive, or the like, preferably at, along, or near the periphery or perimeter of the base 110. Thus, in embodiments where the base 110 is circular in shape, the wall of the bag 1305 and the base 110 form a cylindrical shape, where one end of the cylinder is closed by the base 110, and the other end of the cylinder is open such that items can be placed inside the space formed by the wall of the bag 305 and the base 110. The volume of the bag 305 is typically substantially larger, (e.g., 1.5 times larger, two times larger, three times larger, five time larger, ten times larger, 15 times larger, or more) than the "drawstring" bag formed by pulling the cinch cord 140 to form a spherical-shaped bag as shown in FIG. 5. This makes the bag 1305 useful for grocery shopping, clothes shopping, carrying large items, etc., which cannot fit into the drawstring bag, while the drawstring bag configuration continues to be functional and useful for carrying small items, (such as cosmetics, small toys, and the like), and the containment mat configuration continues to be functional and useful for containing the small items on the base 110 when the drawstring bag is opened into the containment mat configuration.

As is apparent, if the base 110 is not circular, but is instead ovoid, oval, non-circular elliptical, or polygonal in shape, (such as an equilateral, cyclic polygon having six or more sides, e.g., a hexagon, an octagon, a dodecagon, etc.), then the wall of the bag 1305 and the base 110 will not form a bag that is exactly cylindrical in shape, but will instead form a bag that is "approximately cylindrical" in shape or "cylindrical-shaped", which is how those terms are used herein. Moreover, the terms "approximately cylindrical" and "cylindrical-shaped" include exactly cylindrical in shape, and even cuboid in shape (for the case of a square base), and other shapes in between those two, as used herein. Thus, an "approximately cylindrical bag" as used herein may actually be cuboid in shape for an embodiment where the base 110 is a square.

In the example shown, the bag 1305 includes two handles 1310 and 1315. In some embodiments, the handles 1310 and 1315 may be separate components or pieces that are attached (e.g., by stitches) to the wall of the approximately cylindrical bag 1305, as shown in FIG. 13. In various embodiments the handles 1310 and 1315 may be formed of the same or similar materials as any other part or component of the three-way convertible containment device 1100, 100, such as, for example, nylon fabric or polyester fabric. In some embodiments, each handle may be made from one or more strip of material that has a width in the range of approximately two inches, +/− one inch, and that has a length in the range of approximately four inches to 48 inches. For example, each handle may be made of two rectangular strips of material that are sewn together in 2 layers and that have dimensions of two inches wide and 18 inches long. In other embodiments, the handles may instead be former by integral holes or openings in the material of the wall of the bag 1305 (not shown). Yet other embodiments may not have handles. Still other embodiments may include a drawstring (not shown) around the top of the bag 1305, where a hem at the top of the 1305 forms a channel or envelope for the drawstring. In still other embodiments, magnets may be used as a closing means for the top of the bag 1305.

Figure 14:
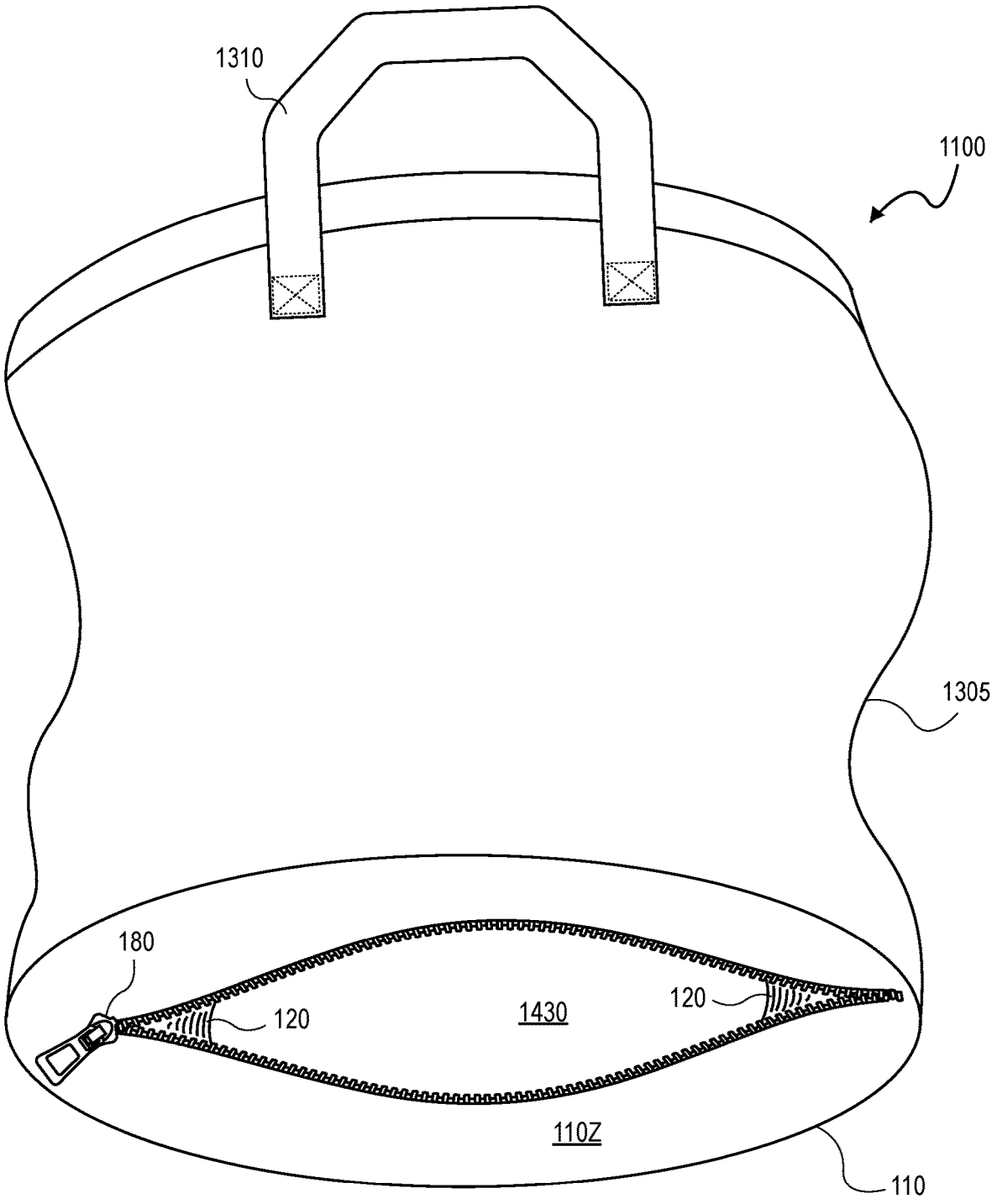
FIG. 14 is a perspective view illustrating the side and bottom of an example of a three-way convertible containment device that is deployed in an approximately cylindrical bag configuration.

FIG. 14 is a perspective view illustrating the side and bottom of an example of the three-way convertible containment device 1100, 100 that is deployed in an approximately cylindrical bag configuration, which may also be referred to as the "shopping bag" configuration. To convert into this configuration, the bag 1305 was pulled completely out of the opening 1430 with the zipper 180, and the base 110 is turned inside out, such that the lip 120 is now in between the layers 110B and 110Z of the base 110, as shown. This places the opening 1430 with the zipper 180 on the outside of the bottom of the approximately cylindrical bag, as shown.

In the example shown, the approximately cylindrical bag 1305 includes two handles, but only a single handle 1310 is visible, as the other handle 1315 is hidden in this perspective view. In the configuration shown, the layer 110Z of the base 110 that includes the opening 1430 and the zipper 180 is the outside bottom of the approximately cylindrical bag. In the configuration of FIG. 14, the side of layer 110Z that is visible in the drawing is the opposite side of layer 110Z that is visible in FIG. 13, because the base 110 has been turned inside out. In FIG. 14, the zipper 180 is open to show that the lip 120 is stored inside the base 110 in this configuration, but a user would likely close the zipper 180 when using the three-way convertible containment device 1100 in the cylindrical-shaped bag configuration. As noted previously, the zipper 180 is optional, and the opening 1430 may have no fastener and/or may have a placket-like design such that there is an overlap of material covering the opening 1430. To convert from the approximately cylindrical bag configuration to the containment mat configuration, a similar procedure as shown in FIGS. 13 and 14 may be performed in reverse to turn the containment lip 120 inside out from between the layers 110Z, 110B and place the approximately cylindrical bag 1305 in between those layers.

It should be noted that the three-way convertible containment device 1100 in the approximately cylindrical bag configuration shown in FIG. 14 may be further configured such that the layer 110Z of the base 110 that includes the opening 1430 and the zipper 180 is the inside bottom of the approximately cylindrical bag. This may be done by turning inside out the approximately cylindrical bag 1305 shown in FIG. 14. The space between the layers of the base 110, which is accessible via the zipper 180 is generally a good place of hold, store, or hide small items, which could include the small items (e.g., cosmetics or toys) that are contained in the containment mat configuration and/or the drawstring bag configuration. The hiding and security aspects of this space are enhanced when the approximately cylindrical bag is configured such that the zipper 180 is inside the approximately cylindrical bag, which makes it more difficult for a person to find and access.

Although FIGS. 13 and 14 show the conversion from the containment mat configuration to the approximately cylindrical bag configuration, it should be noted that the device 100, 1100 can similarly be converted from the drawstring bag configuration to the approximately cylindrical bag configuration in the same manner. Thus, small items that are contained in the drawstring bag would end up contained in the drawstring bag and also contained between the layers 110Z, 110B of the base 110.

Figure 15:
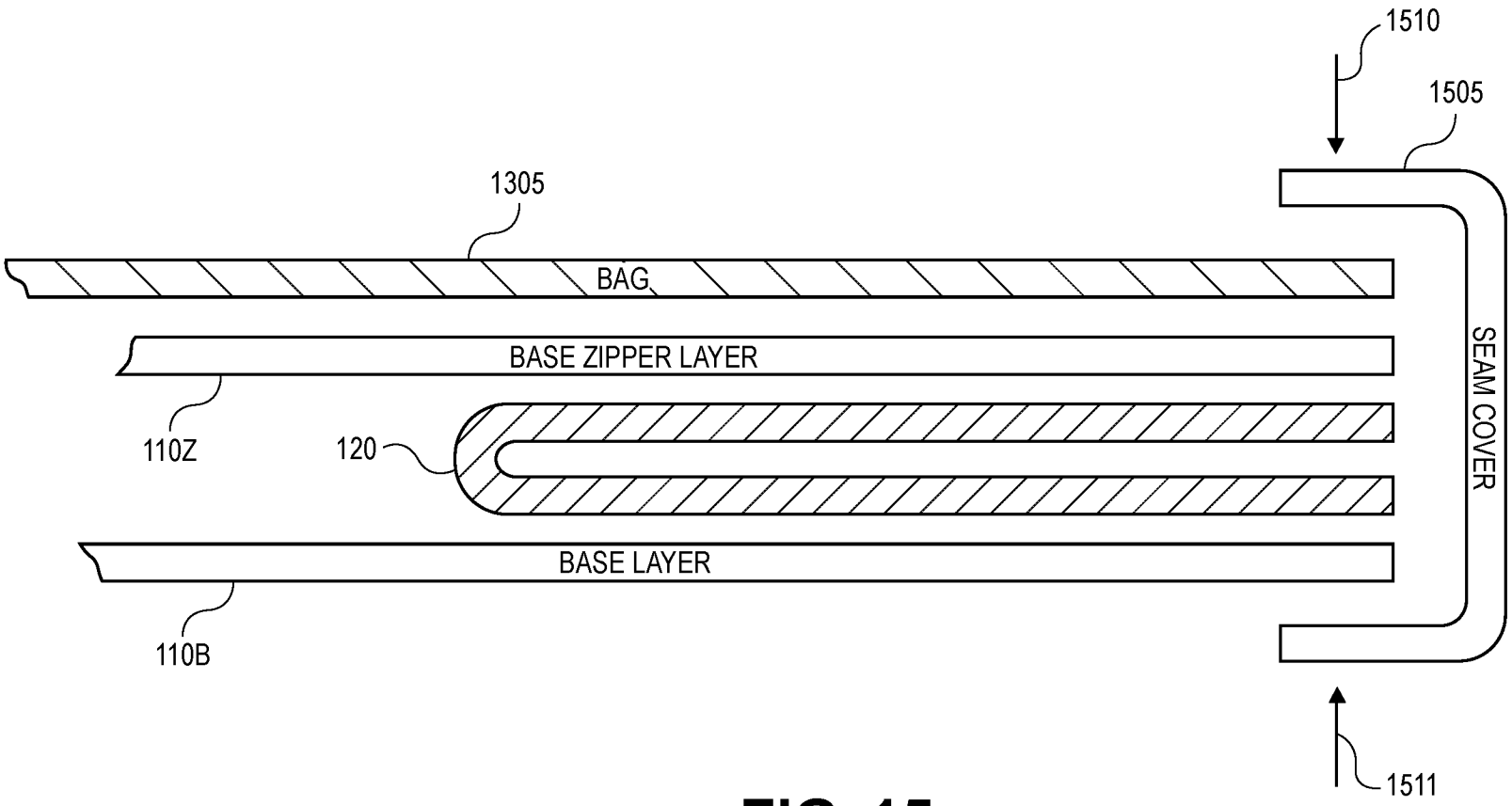
FIG. 15 is a cut-away view of a portion of the periphery of an example of a three-way convertible containment device consistent with the invention.

FIG. 15 is a cut-away view of a portion of the periphery of an example of a three-way convertible containment device 100, 1100 consistent with the invention. This drawing shows one possible way to attach or connect the parts to each other.

In the example shown, the edges of: the bag 1305, the layer 110Z of the base 110 having the opening 1430 with the zipper 180, the folded over lip 120, and the layer 110B of the base 110 without the zipper, are stacked and aligned, or approximately aligned. In various embodiments these parts may be attached by stitches or the like that pass through the parts along the line indicated by the arrows 1510, 1511. In the example shown, (but not necessarily in other embodiments), the edges of the parts may be covered by a seam cover 1505 before being stitched, which gives the three-way convertible containment device a more finished look and helps prevent the edges of the parts 1305, 110Z, 120, and 110B from wearing, fraying, ripping, unravelling, or the like. The seam cover may be formed of the same or a similar material as that used for any of the other parts.

In other embodiments (not shown) that do not employ a seam cover in the manner shown, the orientation of the lip 120 may be reversed, such that the fold of the lip 120 is to the right of the stitch/attachment line indicated by the arrows 1510, 1511. Also in other embodiments, as noted previously, the base layer 110B may include an opening 1430, which may be in addition to, or as an alternative to, the opening 1430 in the layer 110Z. As described previously, any opening 1430 may lack a fastener(s), or it may be open and closable using a fastener, such as the zipper 180. Although a cinch cord 140 is not shown in this example, it would normally be found inside the "U" shape made by the lip 120.

As previously noted, in various embodiments, each part may be made of a flexible material or fabric, such as a polyester fabric, a nylon fabric, a nonwoven material, a plastic material, or the like. Although FIG. 15 shows each part as being approximately the same thickness, none of the drawings are to scale, and in various embodiments, the parts may be different or various thicknesses, e.g., the base layers 110Z and 110B may be formed of a thicker, heavier material than the lip 120 and/or the bag wall 1305. In addition, the parts 1305, 110Z, 120, and 110B may be made of the materials described previously herein.

As described previously herein, one of ordinary skill will recognize that the configuration shown in FIG. 15 is only one possible configuration—namely one wherein the approximately cylindrical bag 1305 is deployed with the base zipper layer 110A acting as the inside bottom of the approximately cylindrical bag 1305 and the non-zipper base layer 110B acting as the outside bottom of the approximately cylindrical bag. One of ordinary skill will recognize that the approximately cylindrical bag 1305 could then be turned inside out and redeployed such that the non-zipper base layer 110B acts as the inside bottom of the approximately cylindrical bag 1305 and the base zipper layer 110Z acts as the outside bottom of the approximately cylindrical bag, as shown, for example, in FIG. 14. One of ordinary skill will further recognize that the three-way convertible containment device 100, 1100 can also be converted to a different configuration than that shown in FIG. 15 by turning it inside out through the zippered opening 1430 in the zipper layer 110Z, such that the approximately cylindrical bag 1305 (and the seam cover 1505 if present) is contained between the base layers 110Z and 110B, and the lip 120 is outside (i.e., no longer between) the base layers 110Z, 110B, as shown for example in FIG. 12.

Figure 16:
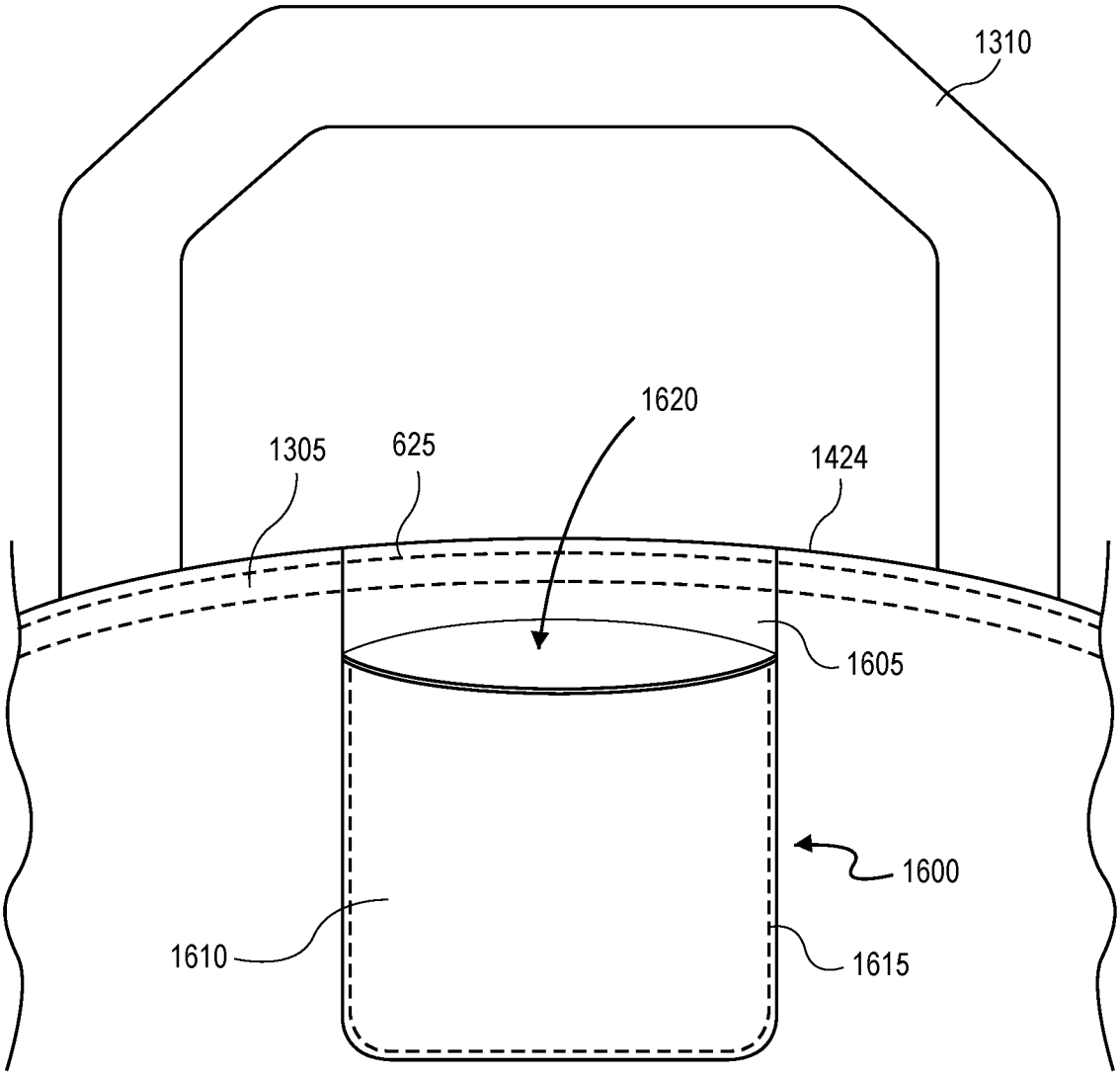
FIG. 16 is a perspective view illustrating an example of a pouch that is attached to a section of the wall of the cylindrical-shaped bag, according to an embodiment of the invention.

FIG. 16 is a perspective view illustrating an example of a pouch 1600 that is attached to a section of the wall of the cylindrical-shaped bag 1305, according to an embodiment of the invention. The pouch 1600 may be used to store the device 100, 1100 when the device is not in use. For example, a user may fold, compress, and/or wad the device 100, 1100 into a shape that fits inside the pouch 1600.

In the embodiment shown, the pouch 1600 is formed of two pieces of material: a first pouch side 1605 and a second pouch side 1610. In some embodiments, as shown in FIG. 16, the second pouch side 1610 may be smaller than the first pouch side 1605; while in other embodiments, the sides 1605, 1610 may be approximately equal in size.

In various embodiments, as shown, the first pouch side 1605 and the second pouch side 1610 may be fastened together, for example using stitches 1615 or the like, in a manner that forms a pouch having an opening 1620 to its internal volume. In other embodiments, the pouch 1600 may be formed of a single piece of material that is folded over and fastened along the edges, for example, using stitches. In various embodiments, the size of the sides 1605 and 1610 are such that the pouch 1600 has sufficient internal volume 1620 to contain the folded up device 100, 1100. Thus, the size of the pouch 1600 will be dependent on the size of the device 100, 1100, which is related to the size of the base 110, the lip 120, the bag wall 1305, the handles 1310, 1315, and the like.

As shown in the example of FIG. 16, the pouch may be attached at or near the top edge 1424 of the cylindrical shaped bag 1305, for example, using stitches 1625. In the embodiment shown, the pouch 1600 is attached between the ends of one of the handles 1320 of the cylindrical shaped bag 1305. In other embodiments, however, the pouch 1600 may be attached in a different location on the device 100, 1100, as the attachment point is not critical. In still other embodiments, the pouch 1600 may be separate from and not attached to the device 100, 1100.

Other embodiments of the invention will be apparent to those skilled in the art from consideration of the specification and practice of the invention disclosed herein. It is intended that the specification and examples be considered as non-limiting examples only.

Specific values for described elements should be understood to be within accepted manufacturing or industry tolerances known to one of skill in the art, and any use of the terms "substantially" and/or "approximately" and/or "generally" should be understood to mean falling within such accepted tolerances.

What is claimed is:

1. A device for containing items, the device comprising:

a flexible, polygonal base that has a perimeter and that comprises a first layer of material and a second layer of material, wherein the first layer of material includes an opening;

a flexible lip having a length that is approximately equal to a circumference of the flexible, polygonal base, the flexible lip comprising at least one piece of thin material that is configured to form at least one envelope;

wherein the flexible lip is attached near the perimeter of the flexible, polygonal base such that, in a first configuration, at least a portion of the flexible lip is disposed partially perpendicular to the flexible polygonal base when the flexible polygonal base is deployed flat in a substantially horizontal position;

at least one cord running through the at least one envelope of the flexible lip, wherein pulling the at least one cord forms the device into a first bag that has an annular passage that is nearly completely closed by the at least one piece of thin material of the flexible lip; and a flexible wall that is attached to the flexible, polygonal base such that the flexible, polygonal base and the wall form an approximately cylindrical bag when the device is in a second configuration;

wherein the flexible wall of the approximately cylindrical bag is disposed between the first layer of material and the second layer of material of the base when the device is in the first configuration, wherein the flexible lip is disposed between the first layer of material and the second layer of material of the base when the device is in the second configuration; and wherein the flexible lip and the flexible wall of the approximately cylindrical bag are attached near the perimeter of the flexible, polygonal base by stitches.

2. The device of claim 1, further comprising:

at least one cord clamping device, adjustable attached to the at least one cord.

3. The device of claim 2, wherein the at least one cord clamping device is a cord lock.

4. The device of claim 1, wherein the at least one piece of thin material that is configured to form at least one envelope comprises two pieces of thin material that are configured to form two envelopes; and wherein the at least one cord running through the at least one envelope of the flexible lip comprises two cords running through the two envelopes.

5. The device of claim 4, further comprising:

two cord locks, adjustable attached to the two cords.

6. The device of claim 1, wherein the at least one piece of thin material comprises at least one piece of thin nylon material or thin polyester material.

7. The device of claim 1, wherein pulling the at least one cord forms the device into a bag that has an annular passage that is completely closed by the at least one piece of thin material of the flexible lip.

8. The device of claim 1, further comprising a fastener connected to the opening, wherein the fastener seals and unseals the opening.

9. The device of claim 1, further comprising a handle connected to the flexible wall of the approximately cylindrical bag.

10. The device of claim 1, further comprising one or more openings in the flexible wall of the approximately cylindrical bag that are configured to function as handles when the device is in the second configuration.

11. A device for containing items, the device comprising:

a flexible, approximately polygonal base that has a perimeter and that comprises a first layer of material and a second layer of material, wherein the first layer of material includes an opening;

a flexible lip having a length that is approximately equal to a circumference of the flexible, approximately polygonal base, the flexible lip comprising at least one piece of thin material that is configured to form at least one envelope;

wherein the flexible lip is attached by stitches to the flexible, approximately polygonal base such that, in a first configuration, at least a portion of the flexible lip is disposed partially perpendicular to the flexible, approximately polygonal base when the flexible, approximately polygonal base is deployed flat in a substantially horizontal position;

at least one cord running through the at least one envelope of the flexible lip, wherein pulling the at least one cord forms the device into a first bag that has an annular passage that is nearly completely closed by the at least one piece of thin material of the flexible lip; and a flexible wall that is attached by stitches to the flexible, approximately polygonal base such that the flexible, approximately polygonal base and the wall form an approximately cylindrical bag when the device is in a second configuration;

wherein the flexible wall of the approximately cylindrical bag is disposed between the first layer of material and the second layer of material of the base when the device is in the first configuration, and wherein the flexible lip is disposed between the first layer of material and the second layer of material of the base when the device is in the second configuration.

12. The device of claim 11, further comprising:

at least one cord clamping device, adjustable attached to the at least one cord.

13. The device of claim 12, wherein the at least one cord clamping device is a cord lock.

14. The device of claim 11, wherein the at least one piece of thin material that is configured to form at least one envelope comprises two pieces of thin material that are configured to form two envelopes; and wherein the at least one cord running through the at least one envelope of the flexible lip comprises two cords running through the two envelopes.

15. The device of claim 14, further comprising:

two cord locks, adjustable attached to the two cords.

16. The device of claim 11, wherein the at least one piece of thin material comprises at least one piece of thin nylon material or thin polyester material.

17. The device of claim 11, wherein pulling the at least one cord forms the device into a bag that has an annular passage that is completely closed by the at least one piece of thin material of the flexible lip.

18. The device of claim 11, further comprising a fastener connected to the opening, wherein the fastener seals and unseals the opening.

19. The device of claim 11, further comprising a handle connected to the flexible wall of the approximately cylindrical bag.

20. The device of claim 11, further comprising one or more openings in the flexible wall of the approximately cylindrical bag that are configured to function as handles when the device is in the second configuration.

* * * * *